US008337182B2

(12) United States Patent
Lee et al.

(10) Patent No.: US 8,337,182 B2
(45) Date of Patent: Dec. 25, 2012

(54) SKINNING OF PROGRESSIVE CAVITY APPARATUS

(75) Inventors: Lawrence Lee, Manvel, TX (US); Robert Ian Robson, Cheltenham (GB); Olivier Sindt, Cheltenham (GB); Michael Shepherd, Stroud (GB); Norman Ward, Gloucester (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1204 days.

(21) Appl. No.: 11/542,052

(22) Filed: Oct. 3, 2006

(65) Prior Publication Data

US 2009/0016893 A1 Jan. 15, 2009

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/48; 418/1; 418/152; 418/153; 418/178

(58) Field of Classification Search ..... 418/1, 48, 418/152, 153, 178, 179

See application file for complete search history.

(56) References Cited

U.S. PATENT DOCUMENTS

| | | | | |
|---|---|---|---|---|
| 1,892,217 | A | 12/1932 | Moineau | |
| 3,084,631 | A | 4/1963 | Bourke | |
| 3,539,279 | A * | 11/1970 | Rider et al. | 418/48 |
| 6,461,128 | B1 * | 10/2002 | Wood | 418/48 |
| 6,568,076 | B2 | 5/2003 | Bottos et al. | |
| 6,604,922 | B1 * | 8/2003 | Hache | 418/48 |
| 7,214,042 | B2 * | 5/2007 | Parrett | 418/48 |
| 2006/0216178 | A1 * | 9/2006 | Sindt et al. | 418/48 |

FOREIGN PATENT DOCUMENTS

| | | | |
|---|---|---|---|
| JP | 2004052655 A | * | 2/2004 |
| WO | WO 2004/036043 | | 4/2004 |

OTHER PUBLICATIONS

JP 2004-052655 A—English translation.*

* cited by examiner

*Primary Examiner* — Theresa Trieu
(74) *Attorney, Agent, or Firm* — Kimberly Ballew

(57) ABSTRACT

A skinned rotor 201 or skinned stator 305 of a progressive cavity apparatus is described. A rotor 201 can be skinned by threading a sleeve 210 with a profiled helical outer 212 and profiled helical inner 214 surface onto a core 202 with a profiled helical outer surface 204. A rotor (1301, 1401) can also be skinned by inserting a non-helical core (1302, 1402) into a non-helical longitudinal bore (1314, 1414) of a sleeve (1310, 1410) with a profiled helical outer surface (1312, 1412). A stator 305 can be skinned by threading a tubular liner 310 with profiled helical inner 314 and profiled helical outer 312 surfaces into a profiled helical bore 308 of a tube 306. A stator (2405, 2505) can also be skinned by inserting a tubular liner (2410, 2510) with a non-helical outer surface (2412, 2512) into a non-helical bore (2408, 2508) of a tube (2406, 2506).

16 Claims, 21 Drawing Sheets

SKINNING OF PROGRESSIVE CAVITY APPARATUS

BACKGROUND

The invention relates generally to rotors and stators for use with progressive cavity pumps or motors. More specifically, to a skinned stator and/or skinned rotor and method of skinning.

Progressive cavity pumps or motors, also referred to as a progressing cavity pumps or motors, typically include a power section 100, as shown in prior art FIG. 1, consisting of a rotor 101 with a profiled helical outer surface 103 disposed within a stator 105 with a profiled helical inner surface 107. Although the stator 105 is shown with a profiled helical outer surface 111, progressive cavity apparatuses are not so limited, for example, the outer surface can be cylindrical if desired. The rotor and stator of a progressive cavity apparatus operate according to the Moineau principle, originally disclosed in U.S. Pat. No. 1,892,217. Preferably, a rotor has one less lobe than a stator.

In use as a pump, relative rotation is provided between the stator and rotor by any means known in the art, and a portion of the profiled helical outer surface of the rotor engages the profiled helical inner surface of the stator to form a sealed chamber or cavity. As the rotor turns eccentrically within the stator, the cavity progresses axially to move any fluid present in the cavity.

In use as a motor, a fluid source is provided to the cavities formed between the rotor and stator. The pressure of the fluid causes the cavity to progress and imparts a relative rotation between the stator and rotor. In this manner fluidic energy can be converted into mechanical energy.

As progressive cavity pumps or motors typically rely on a seal between the stator and rotor surfaces, at least one of the active surfaces preferably includes a resilient or dimensionally forgiving material. An interference fit between the rotor and stator can be achieved if at least one of the rotor or the stator interface surfaces is made of resilient material. A resilient material further allows power section operation with a fluid containing solid particles as the solids can be temporarily embedded in the resilient material at the sealing interface of the active surfaces of a rotor and stator. The resilient material is frequently a layer of elastomer, which can be relatively thin or thick, disposed in the interior surface of the stator. However a layer of resilient material can be disposed on the surface of a rotor. A stator or rotor with a thin elastomeric layer is generally referred to as thin wall or even wall design.

An elastomeric lined stator with a uniform or even thickness elastomeric layer has previously been disclosed in U.S. Pat. No. 3,084,631 on "Helical Gear Pump with Stator Compression". The prior art has evolved around the principle of injecting an elastomer into a relatively narrow void between the profiled helical bore of a stator and a mandrel with a profiled helical outer surface. The mandrel is then removed after curing of the elastomer and the remaining assembly forms the elastomeric lined stator. The elastomer layer is essentially the last component formed.

The stator bodies mentioned above have a pre-formed profiled helical bore. The profiled helical bore of a stator is generally manufactured by methods such as rolling, swaging, or spray forming, as described in U.S. Pat. No. 6,543,132 on "Methods of Making Mud Motors", incorporated by reference herein. Similarly, a profiled helical bore can be formed by metal extrusion, as described in U.S. Pat. No. 6,568,076 on "Internally Profiled Stator Tube", incorporated by reference herein. Further, various hot or cold metal forming techniques, such as pilgering, flow forming, or hydraulic forming, as described in P.C.T. Pub. No. WO 2004/036043 A1 on "Stators of a Moineau-Pump", incorporated by reference herein, can be used to form a stator with a profiled helical bore.

A stator can also be formed by creating a profiled helical bore in relatively thin metal tubing. This formed metal tube can then be used as the stator by itself or be inserted into a second body with a circular longitudinal bore to form the stator. A stator with a profiled helical bore can also be formed through other process such as sintering or hot isostatic pressing of powdered materials, for example, a metal, or the profiled helical bore can be machined directly into a body.

The prior art designs lead to several inherent manufacturing problems when lining the profiled helical bore of the stator with an injected or molded elastomeric layer, for example, rotational and lateral misalignment. Rotational misalignment can occur when the apex of a lobe of a stator and the apex of an adjacent lobe of the mandrel are not substantially aligned relative to a radial line extending from the central axis during the elastomer injection step. The result is a loss of control of the elastomer thickness on both sides of a lobe. One side of each lobe has an elastomeric layer thicker than intended, and the other side of each lobe has an elastomeric layer thinner than intended.

Another obstacle to forming an elastomeric layer in a stator can be lateral misalignment of the mandrel and the stator. When forming an elastomeric layer, there can be lateral misalignment of the profiled helical bore of the stator and the mandrel. For example, in a long stator there can be lateral misalignment at the mid section even when the ends of the stator and the mandrel are aligned properly due to a sagging of the mandrel and/or the stator. Lateral misalignment during the elastomer injection step creates a loss of control of the elastomer thickness in the profiled helical bore, where one side of the bore has an elastomeric layer thicker than intended and the other side of the bore has an elastomeric layer thinner than intended.

Traditionally, rotors are made of non-compliant material, for example, metal, and the stators are made of non-compliant material housings with an elastomeric lining on the profiled helical bore to run against the rotor. A rotor can be a non-compliant core with a profiled helical outer surface. The core, or bar, can optionally have a bore along the axis for flow bypass. A rotor, or stator, can also be a shell type, such as those rotors available under the registered mark of Even Wall produced by Wilhelm Kächele as shown in prior art FIG. 1. A stator can be metallic tube with a longitudinal bore that is either straight or has a profiled helical form. Straight (e.g., not profiled helical) longitudinal bores can be internally lined with elastomeric material to form the stator profile. A profiled helical bore of a metallic tube is typically for use with thin elastomeric layers.

As the power section of a progressive apparatus, which includes the profiled helical outer surface of a rotor and the profiled helical bore of a stator, is subject to wear and tear, it can be desirable to replace or repair the active surface, i.e., those surfaces of the power section that are exposed to motive fluid. The typically eccentric motion between rotor and stator can create heat that degrades these active surfaces. A resilient material, for example, elastomer, can reach its limit in tensile strength and the high shear and tensile stresses imposed by the eccentrically spinning rotor can tear through any embrittled sections and cause failure of the resilient material. The loss of sections of elastomer is a phenomenon known as chunking and can destroy the usefulness of a progressive cavity apparatus.

A replaceable skin on a rotor and/or in a stator can have many benefits. For example, 1) a skin can be replaced during part refurbishment instead of requiring the entire component (e.g. stator or rotor) to be replaced, 2) rotors and/or stators can be refurbished at a service shop instead of at a central vendor location, 3) smooth continuous skins can be placed over rough and/or discontinuous components, and 4) skins of different thickness can be used to fit the application requirements and/or manufacturing processes.

SUMMARY OF THE INVENTION

The present invention is directed to skinning an active surface of a progressive cavity apparatus. More specifically, the invention is directed to a rotor with an outer replaceable sleeve and/or a stator with an inner replaceable tubular liner. A sleeve can be disposed on a core with a profiled helical surface to form a rotor. A tubular liner can be disposed in a profiled helical bore of a body to form a stator. The body can be a tube, for example. A tubular liner or sleeve can be a single layer of material or a plurality of material layers.

A rotor of a progressive cavity apparatus can include a core with a profiled helical outer surface, and a sleeve with a profiled helical inner and a profiled helical outer surface, the sleeve removably received on the core. A sleeve can include a resilient material, a non-compliant material, an outer coating of chrome, a semi-compliant material, and/or a slightly compliant material. A sleeve can be a plurality of layers and can include a resilient outer layer and a semi-compliant inner layer, a slightly compliant outer layer and a resilient inner layer, a resilient outer layer and a non-compliant inner layer, a resilient outer layer and a mesh tube inner layer, or a mesh tube encapsulated by a layer of a resilient material.

In another embodiment, a rotor of a progressive cavity apparatus can include a core, and a sleeve with a profiled helical outer surface and a longitudinal bore removably receiving the core. A sleeve can be a plurality of layers and can include a resilient outer layer and a semi-compliant inner layer, the longitudinal bore extending through the semi-compliant inner layer or a resilient outer layer and a non-compliant inner layer, the longitudinal bore extending through the non-compliant inner layer. A transverse cross-section of the core and a transverse cross-section of the longitudinal bore can be circular. A rotor can include a key disposed in a key slot on one end of the core and an adjacent end of the sleeve to restrict relative rotation therebetween. A transverse cross-section of the core and a transverse cross-section of the longitudinal bore can be polygonal to restrict relative rotation therebetween. A rotor can include a core threadably engaged within the longitudinal bore of the sleeve.

In yet another embodiment, a stator of a progressive cavity apparatus can include a tube with a profiled helical bore, and a tubular liner with a profiled helical outer and a profiled helical inner surface, the tubular liner removably received in the profiled helical bore. A tubular liner can include a resilient material, a non-compliant material, an outer coating of chrome, a semi-compliant material, and/or a slightly compliant material. A tubular liner can be a plurality of layers and can include a resilient inner layer and a semi-compliant outer layer, a slightly compliant inner layer and a resilient outer layer, a resilient inner layer and a non-compliant outer layer, a resilient inner layer and a mesh tube outer layer, and a mesh tube encapsulated by a layer of a resilient material.

A tube can include a plurality of tube sections. An end of a tube section can be aligned with an end of an adjacent tube section by a plurality of dowel pins disposed therebetween in a plurality of dowel pin cavities in the end of each tube section. An end of a tube section can be aligned with an end of an adjacent tube section by a nested joint and a key disposed in a key slot formed therebetween. An end of a tube section can be aligned with an end of an adjacent tube section by a nested joint formed therebetween and a plurality of dowel pins disposed therebetween in a plurality of dowel pin cavities in the end of each tube section. An end of a tube section can be joined to an end of an adjacent tube section by a weld formed therebetween.

In another embodiment, a stator of a progressive cavity apparatus can include a tubular liner with a profiled helical inner surface, and a tube with a longitudinal bore removably receiving the tubular liner. A tubular liner can be a plurality of layers and can include a resilient inner layer and a semi-compliant outer layer or a resilient inner layer and a non-compliant outer layer. A transverse cross-section of an outer surface of the tubular liner and a transverse cross-section of the longitudinal bore can be circular. A stator can include a key disposed in a key slot in an end of the longitudinal bore and the adjacent outer surface of the tubular liner to restrict relative rotation therebetween. A transverse cross-section of an outer surface of the tubular liner and a transverse cross-section of the longitudinal bore are polygonal to restrict relative rotation therebetween. A tubular liner can be threadably engaged within the longitudinal bore of the tubular liner.

In yet another embodiment, a method of skinning a rotor of a progressive cavity apparatus can include providing a core with a profiled helical outer surface, and threading the core into a sleeve with a profiled helical inner and a profiled helical outer surface to form a skinned rotor. A method can include installing the skinned rotor into the progressive cavity apparatus. The step of threading can include engaging an end of the core into an end of the sleeve, and providing relative rotation between the sleeve and the core to substantially dispose the core into the sleeve, wherein at least a portion of the profiled helical outer surface of the core threadably engages at least a portion of the profiled helical inner surface of the sleeve.

The step of threading can include engaging an end of the core into an end of the sleeve, and providing axial displacement between the sleeve and the core to rotatably dispose the core into the sleeve, wherein at least a portion of the profiled helical outer surface of the core threadably engages at least a portion of the profiled helical inner surface of the sleeve. The method can include removing the sleeve from the core, and threading the core into a second sleeve with a profiled helical inner and a profiled helical outer surface. The sleeve can include a plurality of layers, at least one layer a different material than a second layer.

In another embodiment, a method of skinning a rotor of a progressive cavity apparatus can include providing a core, and inserting the core into a sleeve with a profiled helical outer surface and a longitudinal bore, the longitudinal bore removably receiving the core. A transverse cross-section of the core and a transverse cross-section of the longitudinal bore can be circular. A transverse cross-section of the core and a transverse cross-section of the longitudinal bore can be polygonal to restrict relative rotation therebetween. A method of skinning a rotor can include engaging a key in a slot on an end of the core and an adjacent end of the sleeve to restrict relative rotation therebetween. The step of inserting the core into the sleeve can include threadably engaging a threaded outer surface of the core into a threaded inner surface of the longitudinal bore.

In yet another embodiment, a method of skinning a stator of a progressive cavity apparatus can include providing a tubular liner with a profiled helical inner and a profiled helical outer surface, and threading the tubular liner into a profiled helical bore of a tube to form a skinned stator. The method can include installing the skinned stator to the progressive cavity apparatus. The step of threading can include engaging an end of the tubular liner into an end of the profiled helical bore, and providing relative rotation between the tubular liner and the profiled helical bore to substantially dispose the tubular liner into the profiled helical bore, wherein at least a portion of the profiled helical outer surface of the tubular liner threadably engages at least a portion of the profiled helical bore of the tube. The step of threading can include engaging an end of the tubular liner into an end of the profiled helical bore, and providing axial displacement between the tubular liner and the profiled helical bore to rotatably dispose the tubular liner into the profiled helical bore, wherein at least a portion of the profiled helical outer surface of the tubular liner threadably engages at least a portion of the profiled helical bore of the tube. The method can include removing the tubular liner from the profiled helical bore, and threading a second tubular liner with a profiled helical inner and a profiled helical outer surface into the profiled helical bore. The tubular liner can include a plurality of layers, at least one layer a different material than a second layer. The method of skinning a stator can include joining a plurality of tube sections to form the tube before the step of threading.

The step of joining can include attaching an end of a tube section to an end of an adjacent tube section by a weld formed therebetween. The method of skinning a stator can include aligning an end of a tube section with an end of an adjacent tube section by a plurality of dowel pins disposed therebetween in a plurality of dowel pin cavities in the end of each tube section before the step of joining. The method of skinning a stator can include aligning an end of a tube section with an end of an adjacent tube section by a nested joint formed therebetween and disposing a key in a key slot formed therebetween before the step of joining. The method of skinning a stator can include aligning an end of a tube section with an end of an adjacent tube section by a nested joint formed therebetween and a plurality of dowel pins disposed therebetween in a plurality of dowel pin cavities in the end of each tube section before the step of joining.

In another embodiment, a method of skinning a stator of a progressive cavity apparatus can include providing a tubular liner with a profiled helical inner surface, and inserting the tubular liner into a longitudinal bore of a tube. A transverse cross-section of an outer surface of the tubular liner and a transverse cross-section of the longitudinal bore can be circular or can be polygonal to restrict relative rotation therebetween. The method can include engaging a key in a key slot on an outer surface of the tubular liner and in an adjacent slot in the longitudinal bore to restrict relative rotation therebetween. The step of inserting the tubular liner into the longitudinal bore can include threadably engaging a threaded outer surface of the tubular liner into a threaded inner surface of the longitudinal bore.

In yet another embodiment, a method of forming a profiled helical sleeve of a rotor can include disposing a tube over a core having a profiled helical outer surface, an inner peripheral length of the tube substantially similar to a peripheral length of the profiled helical outer surface of the core, and twisting and imparting axial tension to the tube to conform the tube to the profiled helical outer surface to form the profiled helical sleeve. The tube can have an annular transverse cross-section. The tube can have a circular inner surface for example, before the step of twisting and imparting axial tension. The tube can be a mesh tube, a solid walled tube, a resilient material, an elastomer, or a mesh tube encapsulated by a layer of a resilient material.

In another embodiment, a method of forming a profiled helical tubular liner of a stator can include disposing a first tube in a profiled helical bore of a second tube, an outer peripheral length of the first tube substantially similar to a peripheral length of the profiled helical bore, and twisting and imparting axial compression to the first tube to conform the first tube to the profiled helical bore to form the profiled helical tubular liner. The first tube can have an annular transverse cross-section. The first tube can have a circular outer surface, for example, before the step of twisting and imparting axial compression. The first tube can be a mesh tube, a solid walled tube, a resilient material, an elastomer, or a mesh tube encapsulated by a layer of a resilient material.

In yet another embodiment, a method of skinning a stator of a progressive cavity apparatus can include conforming a first tube to a mandrel having a profiled helical outer surface to create or impart a tubular liner with a profiled helical inner and a profiled helical outer surface, and threading the tubular liner into a profiled helical bore of a second tube to form a skinned stator. The first tube can be a resilient material. The method can include curing the conformed resilient material tube to retain a profiled helical form of the core. The resilient material can be at least partially uncured during the conforming step. The method can include removing the mandrel from the tubular liner before, during, and/or after the step of threading.

DETAILED DESCRIPTION OF THE INVENTION

Figure 1:
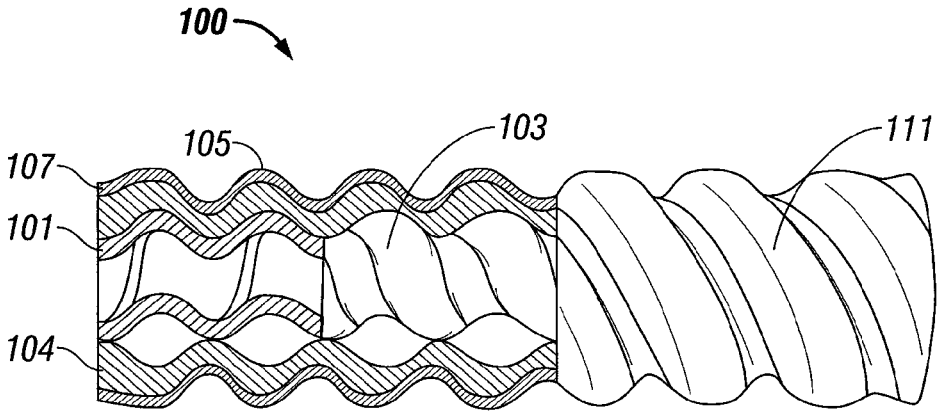
PRIOR ART FIG. 1
FIG. 1 is a cross-sectional view of a prior art power section that includes a profiled helical tube rotor disposed within a profiled helical tube stator lined with a layer of resilient material.

Prior art FIG. 1, discussed in the background section above, is a power section 100 of a progressive cavity apparatus. Power section 100 includes a profiled helical tube rotor 101 disposed within a profiled helical tube stator 105 lined with a layer of resilient material 107. The term profiled shall refer to a substantially non-circular transverse cross-section, for example, a lobed or corrugated cross-section of a rotor (FIG. 2) or a stator (FIG. 3) for use as a power section of a progressive cavity apparatus. A layer of resilient material 107 is typically injection molded into the stator 105 and is thus bonded to the stator 105. To reline such a lined stator means mechanical or chemical means are used to strip any resilient material 107 out of the bore and a second layer of resilient material 107 is injection molded. The benefits of skinning a rotor (FIG. 2) and/or a stator (FIG. 3) to create a more readily replaceable skin are obvious, including, but not limited to, allowing in-field repair or refurbishment without requiring injection molding equipment. Further, the skin is not limited to being resilient material and can be any material. The term skin shall refer to a replaceable surface lining and includes a sleeve (rotor embodiment) and/or a tubular liner (stator embodiment). Although illustrated in reference to rotors and/or stators of progressive cavity apparatuses, the invention can be utilized with any type of rotor and/or stator without departing from the spirit of the invention. The invention applies to both stators and rotors even if only a rotor or stator is used to describe the embodiment.

Figure 2:
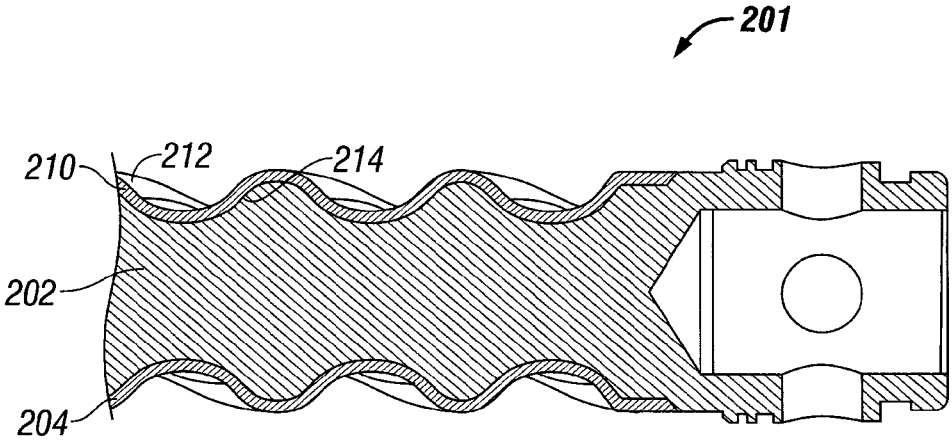
FIG. 2 is a cross-sectional view of a rotor formed from a sleeve disposed on a core with a profiled helical outer surface, according to one embodiment of the invention.

FIG. 2 is a skinned rotor 201, according to one embodiment of the invention. The rotor 201 consists of a sleeve 210, that forms the replaceable skin, disposed on a core 202. Core 202 has a profiled helical outer surface 204 and can have a longitudinal bore (not shown) extending through the axis. As used herein, the terms inner and outer are construed relative to the longitudinal axis of an element. Sleeve 210 has a profiled helical outer surface 212 and a profiled helical inner surface 214. Profiled helical outer surface 212 is the active surface of the rotor 201. One embodiment of the active profiled helical surface of a rotor 212 or stator (inner surface 314 in FIG. 3) can have a relatively long pitch length (the axial distance of one 360-degree helical turn of one lobe), for example, a pitch length between two to twenty times that of the major diameter. Profiled helical inner surface 214 of the sleeve 210 is not required to have the same profiled helical form (e.g., number of lobes, pitch, etc.) as the profiled helical outer surface 212. In one embodiment, the profiled helical outer surface 204 of the core 202 can have a substantially similar form as the profiled helical inner surface 214 of the sleeve 210, for example, to create a substantially constant thickness skin.

A skinned rotor 201 can have adjacent sleeve 210 and core 202 surfaces (e.g., 204, 214) of substantially the same size, preferably where the profiled helical outer surface 204 of the core 202 is at least of a slightly smaller diameter relative to the profiled helical inner surface 214 of the sleeve 210. This allows the sleeve 210 to be slidably disposed (e.g., threaded) onto the profiled helical outer surface 204 of the core 202, as is discussed further herein.

Sleeve and/or core and tubular liner and/or tube are not required to be a constant thickness and can be variable thickness as is known to one of ordinary skill in the art. For example, the sleeve or tubular liner can be thicker at a peak of each lobe and thinner in the valley between each lobe, and vice-versa. A skin can be designed so as to be interchangeable between a plurality of rotor cores. Similarly, a skin can be designed so as to be interchangeable between a plurality of stator tubes.

Figure 3:
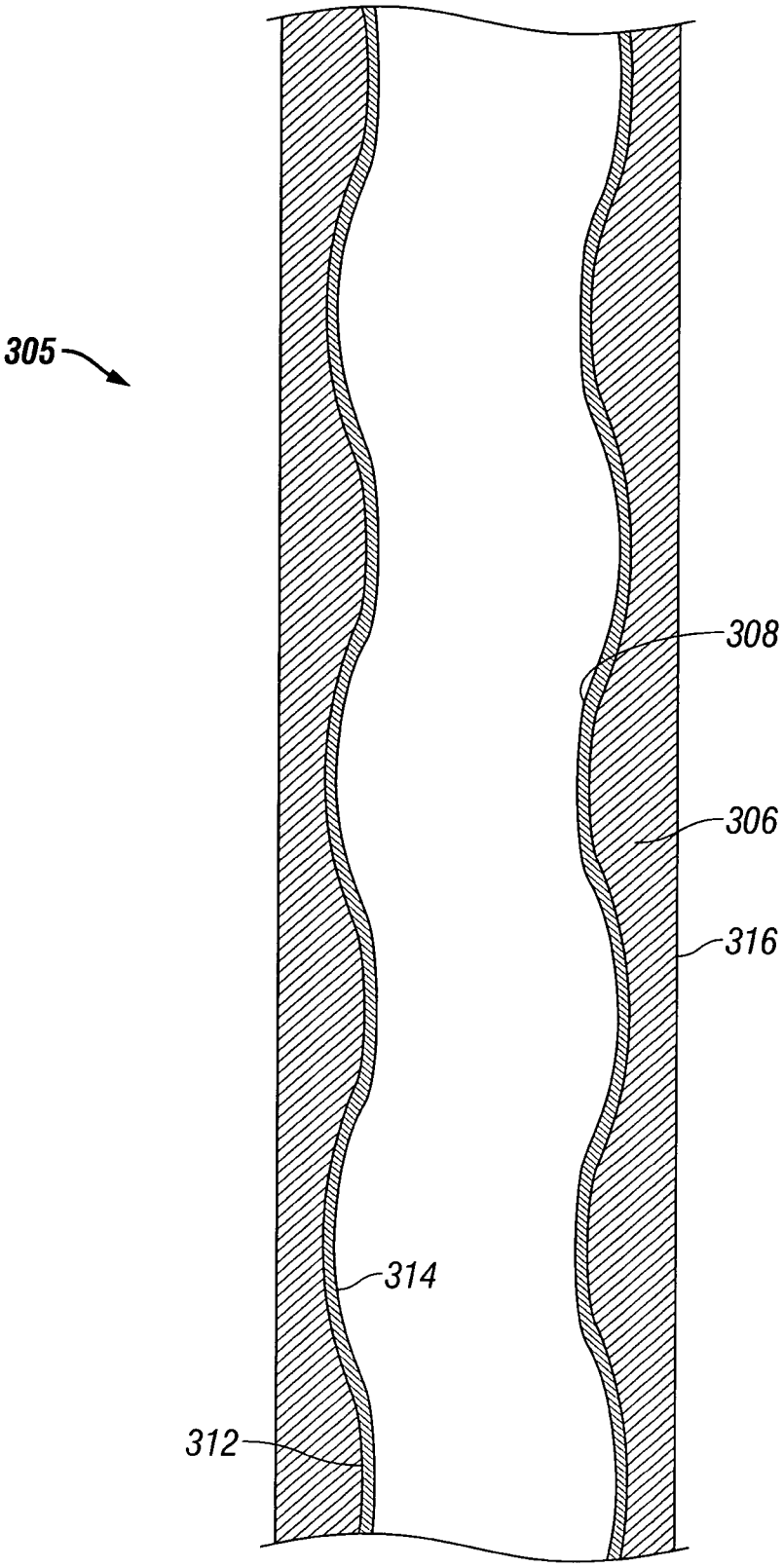
FIG. 3 is a cross-sectional view of a stator formed from a tubular liner disposed within the profiled helical bore of a tube, according to one embodiment of the invention.

The invention is not limited to a skinned rotor as in FIG. 2. A stator can be skinned without departing from the spirit of the invention. FIG. 3 is cross-sectional view a stator 305 including a tubular liner 308 with a profiled helical outer 312 and profiled helical inner surface 314 disposed within the profiled helical bore of a tube 306, wherein said tubular liner 308 is the replaceable skin.

A skin with a profiled helical inner surface and profiled helical outer surface, whether a sleeve for skinning a rotor or a tubular liner for skinning a stator, can be formed by any method, which can depend on the type of material or materials used in the skin. A few non-limiting examples of methods of forming a skin with a profiled helical inner and profiled helical outer surface are cold flow forming, molding, and hydroforming. A skin can utilize further mechanical support to serve as an active surface of a progressive cavity apparatus, for example, a sleeve can be supported by the profiled helical surface of a core to form a rotor. A sleeve can be circumferentially continuous and/or longitudinally continuous.

A profiled helical bore of a tube to form a stator or a profiled helical outer surface of a core to form a rotor can be a pre-existing stator or rotor, further to compensate for the thickness of the skin, the profiled helical bore or outer surface of a pre-existing stator or rotor can be machined down to result in the desired size when skinned.

Figure 4:
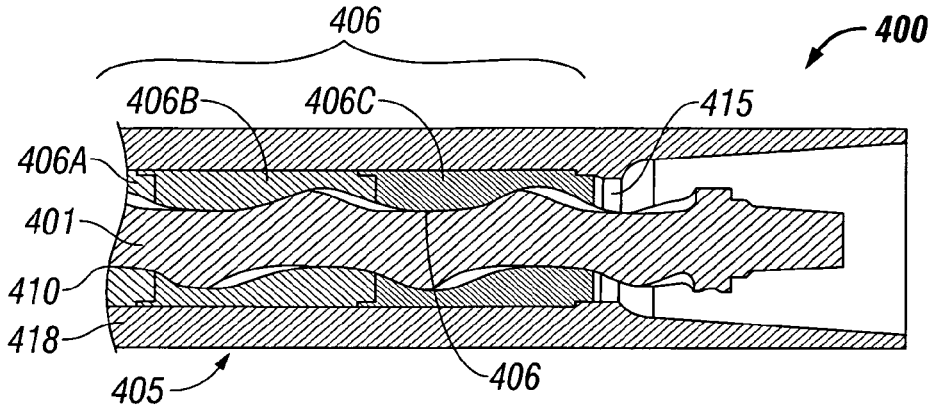
FIG. 4 is a cross-sectional view of an assembled rotor and skinned stator of a progressive cavity apparatus, the stator formed from a tubular liner disposed within the profiled helical bore of a tube, according to one embodiment of the invention.

FIG. 4 illustrates an un-skinned rotor 401 (e.g., no sleeve) disposed in a skinned stator 405 to form a progressive cavity apparatus 400. Although the installed rotor 401 is shown as un-skinned, a skinned rotor (FIG. 2) can be utilized with a skinned stator 405 without departing from the spirit of the invention. A skinned rotor (FIG. 2) can be used with a skinned stator according to this invention or an un-skinned stator as exists in the prior art. A skinned stator can be used with a skinned rotor according to this invention or an un-skinned rotor. Note un-skinned does not refer to being unlined, as the layer of resilient material 109 that forms the elastomeric lining in prior art FIG. 1 is not a removable skin according to the invention as it is molded in-place.

Bearing 415 in FIG. 4, which can allow for eccentric movement, can be any type of bearing known in the art, for example, a support bearing. Support bearings 415 on each end of the progressive cavity apparatus 400 can further function to inhibit axial movement of tubular liner 410 with respect to the profiled helical bore of the tube 406. Support bearings 415 can also inhibit axial displacement between a sleeve disposed on a core to form a rotor (not shown). However no support bearing is required. Further, any means known in the art can be used to restrict or inhibit axial and/or rotational movement between a tubular liner 410 and profiled helical bore and/or a sleeve (210 in FIG. 2) and a profiled helical outer surface (204) of a core (202), for example, adhesive, wire, fasteners, hook-and-loop fasteners, etc. In one embodiment, a tubular liner 410 and profiled helical bore and/or a sleeve (210 in FIG. 2) and a profiled helical outer surface (204) of a core (202) are not bonded together. For example, the frictional contact between opposing surfaces of a sleeve and rotor (or tubular liner and profiled helical bore) can restrict relative rotation therebetween. The tube 406 comprises a plurality of tube sections 406A, 406B, and 406C disposed within a tubular housing 418, however the tube 406 can be a one piece tube with no tubular housing 418.

As used herein, in reference to any rotor or stator embodiment, the term resilient shall refer to any material capable of substantially returning to an original shape or position, as after having been compressed, for example, an elastomer, rubber (e.g., nitrile or silicone) propylene, fluorocarbon, urethane, or polyurethane. A resilient material can have hardness of less than about 90 durometer or a hardness in the Shore A scale.

The term non-compliant shall refer to a material that is not capable of being readily or easily disposed to comply on a local scale, for example, a metal (e.g., steel, aluminum, or copper), powder metal, ceramic, or other material structurally sufficient for use in a progressive cavity apparatus. Non-compliant material can have hardness measured in the Brinell or Rockwell scale.

The term semi-compliant shall refer to any material that is substantially non-compliant but allows some degree of elastic deformation when force is applied, for example, a polymer, including, but not limited to, nylon, ethylene vinyl acetate, acrylic (e.g., acrylic glass), or polyethylene. Semi-compliant material can have a hardness in the Shore D scale.

The term slightly compliant shall refer to any material that allows a higher level of elastic deformation than a semi-compliant material as defined above but less than a resilient material, for example, silicon or polytetrafluoroethylene. In one embodiment, the slightly compliant material can have a relatively low friction factor and/or a high resistance to abrasion.

Figure 5:
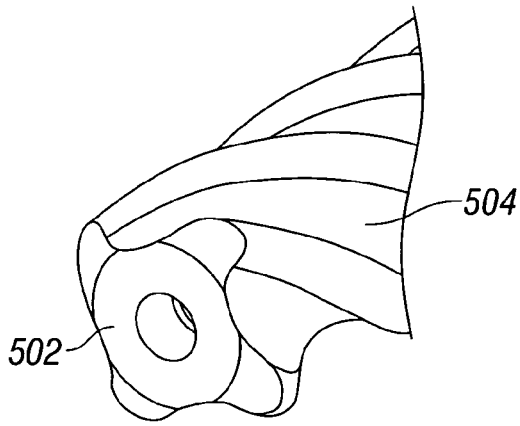
FIG. 5 is a perspective view of an unskinned core with a profiled helical outer surface used to form a skinned rotor, according to one embodiment of the invention.

FIG. 5 is a core 502 with a profiled helical outer surface 504 which can be skinned to form a rotor. Core 502 can include a longitudinal passage (not shown) or be a hollow shell. Core 502 can be any material, including, but not limited to, metal, polymer, composite fibers, or any combination thereof. Core 502 can be formed from multiple layers of material without departing from the spirit of the invention. The profiled helical outer surface 504 of the core can be imparted or formed by any means know to one of ordinary skill in the art. To create a rotor, the core 502 is disposed within a sleeve.

Figure 6:
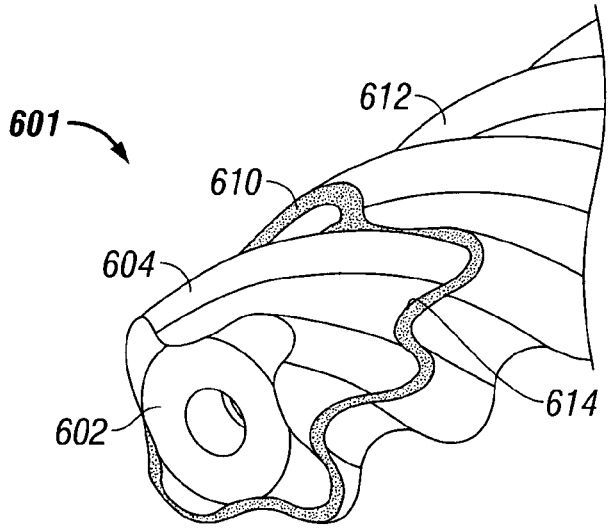
FIG. 6 is a perspective view of a rotor formed from a core with a profiled helical outer surface, the core disposed within a sleeve with a profiled helical inner and profiled helical outer surface, according to one embodiment of the invention.

FIG. 6 is a relatively thin, as compared to the diameter of the core 602, single layer sleeve disposed on a core 602 having a profiled helical outer surface 604. A sleeve 610 can be any material, including, but not limited to, metal, polymer, composite fibers, or any combination thereof. Sleeve 610 can be formed from a plurality of layers of similar and/or dissimilar materials without departing from the spirit of the invention. Sleeve can further be coated with any material if so desired. Sleeve can be a resilient, non-compliant, semi-compliant, slightly compliant material, or any combination thereof, as defined above. Preferably, the material is sufficient for use in a progressive cavity apparatus and the forces encountered therein.

Sleeve can be formed by any means known in the art, including, but not limited to, molding a sleeve with a profiled helical inner and outer surface, forming a cylindrical or annular tube into a sleeve with a profiled helical inner and/or outer surface by some mechanical, hydraulic, and/or pneumatic means, or extruding a sleeve with a profiled helical inner and profiled helical outer surface. One method of forming a sleeve with a profiled helical inner and outer surface by extrusion is described in patent application U.S. Ser. No. 11/496,675 titled "Method and Apparatus for Extrusion of Profiled Helical Tubes", herein incorporated by reference. If so desired, a bonding agent or adhesive can be utilized to affix a portion of a sleeve to a core or to affix a portion of a tubular liner to a profiled helical longitudinal bore of a stator tube.

Sleeves are partially cut away in the figures for illustrative purposes only. The profiled helical outer surface 612 of the sleeve 610 is typically the active surface exposed to the fluid for powering or pumping by a progressive cavity apparatus. Profiled helical inner surface 614 is preferably of substantially the same profiled helical geometry, or form, as the profiled helical outer surface 604 of the core 602. However profiled helical inner surface 614 of the sleeve 610 is not required to have substantially the same profiled helical geometry as the profiled helical outer surface 612 of the sleeve 610. For example, the sleeve inner surface 614 can have three lobes, while the sleeve outer surface 612 has five lobes, for example, to skin a three lobed core to form a rotor with a five lobed outer surface for use within a six lobed stator. The ratio of the major diameter to the minor diameter of the sleeve inner surface 614 can be different, or the same, as the diametric ratio of the sleeve outer surface 612.

When rotor 601 is rotatably mounted within a stator having a longitudinal bore without a resilient layer, at least the outer surface 612 sleeve 610 is preferably a resilient material. The use of a skin, be it a tubular liner (stator) or a sleeve (rotor), has many advantages. For example, a skinned stator or rotor can provide the smooth active surface that is typically required in a progressive cavity apparatus, even if the core or tube that is to be skinned has a non-smooth profiled helical surface. Further, discontinuous sections of a core (rotor) or tube (stator) can be combined and used with a continuous length of skin to form a continuous active surface for use in a progressive cavity apparatus. An existing rotor or stator, whose active surface may or may not be suitable for use in a progressive cavity apparatus, can be skinned without departing from the spirit of this invention. As such the invention can allow previously unusable rotors and/or stators to be refurbished with a skin of any type of material for use in a progressive cavity apparatus. In one embodiment, a sleeve with profiled helical inner and outer surfaces is removably received on a profiled helical core without bonding (e.g., with adhesive) the sleeve to the core. In a non-bonded embodiment, the sleeve can be frictionally retained to the core by the interaction of the outer surface of the core and the inner surface of the sleeve which can aid in the removal and installation of a core and sleeve.

Figure 7:
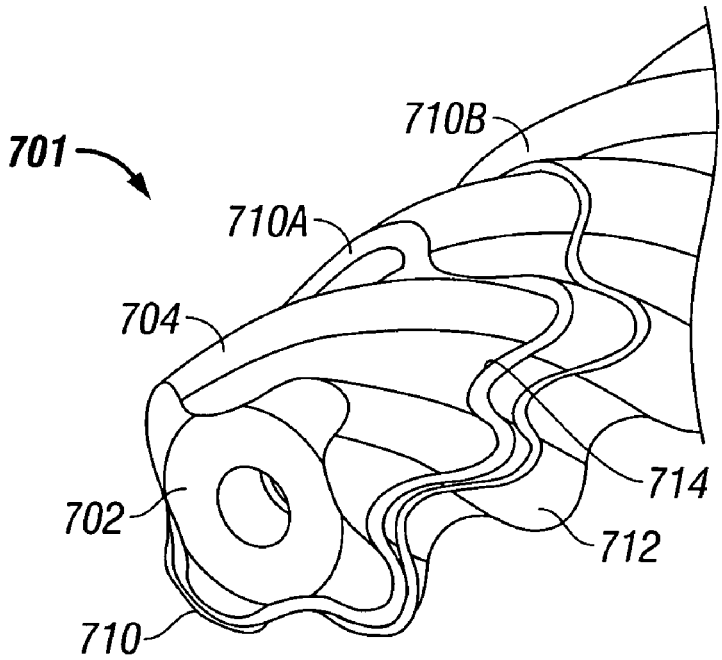
FIG. 7 is a perspective view of a rotor formed from a dual layer sleeve with profiled helical inner and profiled helical outer surface disposed on a core with a profiled helical outer surface, according to one embodiment of the invention.

FIG. 7 is rotor 701 with a dual layer sleeve 710 formed from an inner layer 710A and an outer layer 710B. Sleeve 710 has a profiled helical inner surface 714 and profiled helical outer surface 712. Either layer (710A, 710B) of the sleeve 710 can be of variable or constant thickness. The dual layer sleeve 710 is disposed on a core 702 with a profiled helical outer surface 704. In a one embodiment, the core can be a non-complaint material, such as metal. A sleeve 710 can be formed from multiple layers of the same material with similar or varying durometer measurements. A sleeve 710 can be a combination of different layers of material, for example, inner layer 710A can be a non-compliant material, for example, metal, and outer layer 710B can be a resilient material, for example, elastomer or rubber. In another embodiment, inner layer 710A can be a semi-compliant material, for example, a polymer, and outer layer 710B can be a resilient material, for example, elastomer or rubber. In yet another embodiment, inner layer 710A can be a resilient material, for example, elastomer or rubber, and outer layer 710B can be a slightly compliant material, for example, a thin layer of silicon or polytetrafluoroethylene. Multiple layers of material can be joined together to form a sleeve, or multiple sleeves can be circumferentially disposed, or threaded, within each other to form a skin. A single layer sleeve (e.g. 610 in FIG. 6) can be coated with material to make a dual layer sleeve, for example, by extruding an elastomer on the profiled helical inner or profiled helical outer surface of the sleeve 610 as discussed in US11/496563 titled "Automatic Elastomer Extrusion Apparatus and Method", herein incorporated by reference. The method disclosed therein can also be used to extrude a layer of elastomer or other extrudable material onto a profiled helical inner or profiled helical outer surface of a tubular liner without departing from the spirit of this invention.

Figure 8:
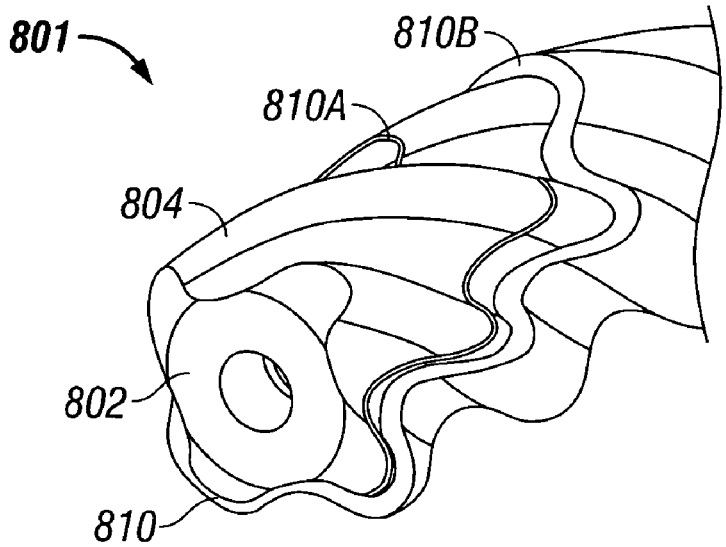
FIG. 8 is a perspective view of a second embodiment of a rotor formed from a dual layer sleeve disposed on a core with a profiled helical outer surface.

FIG. 8 is another embodiment of a dual layer sleeve 810. Inner layer 810A is relatively thinner than outer layer 810B. Inner layer 810A can be a non-compliant material, for example, metal, and outer layer 810B can be a resilient material, for example, elastomer or rubber.

Figure 9:
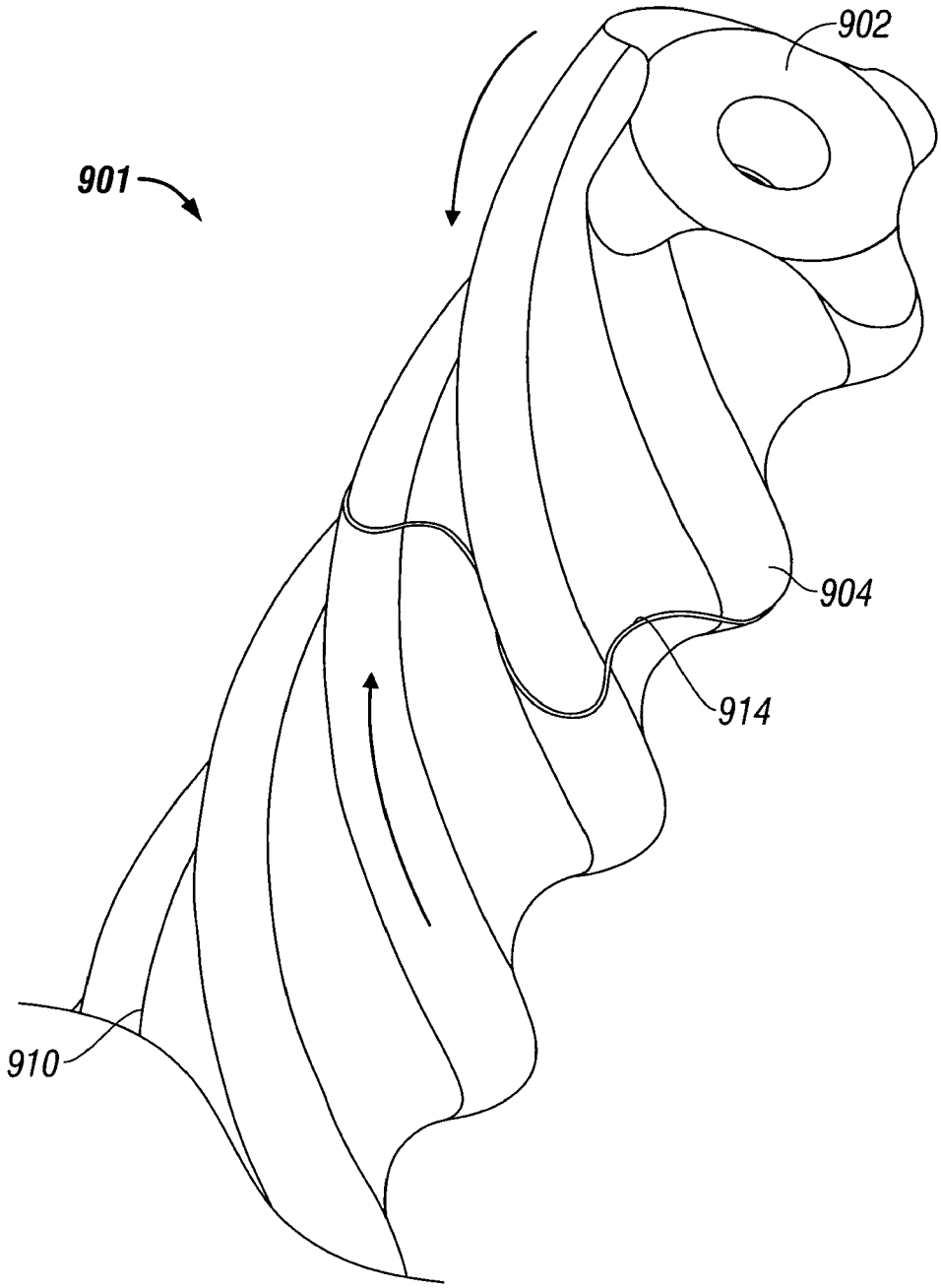
FIG. 9 is an exploded view of a core, with a profiled helical outer surface, being threaded within a sleeve with a profiled helical inner and profiled helical outer surface to form a rotor, according to one embodiment of the invention.

FIG. 9 illustrates a method of skinning a rotor 901 by assembling a core 902 and a sleeve 910. By providing a removable sleeve 910 with a profiled helical inner surface 914 of substantially the same profiled helical geometry, or form, as the profiled helical outer surface 904 of the core 902, core 902 can removably receive the sleeve 910. To form the skinned rotor 901, the sleeve 910 is disposed onto the core 902. One method of assembly is to engage an end of the profiled helical outer surface 904 of the core 902 into the profiled helical inner surface 914, or bore, of the sleeve 910. In one embodiment, the profiled helical inner surface 914 of the sleeve 910 in an un-installed state is sized relative to the profiled helical outer surface 904 of the core 902 so as to allow a slight gap therebetween. In such an embodiment, the core 902 can be threaded into the sleeve 910 so that at least a portion of the profiled helical inner surface 914 of the sleeve 910 engages at least a portion of the profiled helical outer surface 904 of the core 902. The helical form allows the core 902 to be disposed within the sleeve 910 in a manner akin to threading a bolt into a nut or other threadable engagement. In another embodiment, the profiled helical inner surface 914 of the sleeve 910 in an un-installed state is under sized relative to the profiled helical outer surface 904 of the core 902 so as to allow a slight interference therebetween. In such an embodiment, the core 902 can be threaded into the slightly inflated sleeve 904. Diametric inflation of the sleeve 910 can be achieved by applying slight pressure to the interior and/or ends of sleeve 910.

The assembly step can include providing relative rotation and/or axial displacement between the sleeve 910 and core 902. An adhesive or other means of affixing the sleeve 910 to the core 902 can be used, but is not required. Even if a there is a non-frictional fit (e.g. a gap therebetween) of the adjacent profiled helical surfaces (904, 914), relative rotation between the core 902 and sleeve 910 can be impeded by the interaction of said adjacent surfaces (904, 914). Thus if relative axial displacement is restricted, for example, with a bearing 415 of a progressive cavity apparatus as described in reference to FIG. 4, the sleeve 910 will be retained relative to the core 902. A sleeve can be frictionally retained against the core, for example, as is discussed in U.S. patent application Ser. No. 11/385,946 filed Mar. 21, 2006 titled "Downhole Motor Seal and Method", herein incorporated by reference. In such a manner, the sleeve is removable as compared to the profiled helical outer surface of a prior art rotor, which is typically a single piece of metal.

When desired, the sleeve itself can be rapidly replaced, for example, as compared to the typical manner of recoating a rotor with chrome or elastomer. A first sleeve 910 can be slidably disposed off of the core 902 in the threaded helical manner discussed above, and a new sleeve threaded onto the core 902. Similarly, a core 902 can be removed from a sleeve 910 and said sleeve 910 installed on a second core.

Although the assembly step is described in reference to a single layer embodiment of a replaceable sleeve, a sleeve with a plurality of layers can be used without departing from the spirit of the invention. In a dual layer embodiment, for example as in FIGS. 7-8, an inner layer and outer layer can be joined before being threaded onto a core, or the inner layer can be threaded onto the core followed by the outer layer being threaded onto the inner layer and core sub-assembly. In such a manner, any combination of the core, inner layer of the sleeve, and/or outer layer of the sleeve can be replaced as desired.

Figure 10:
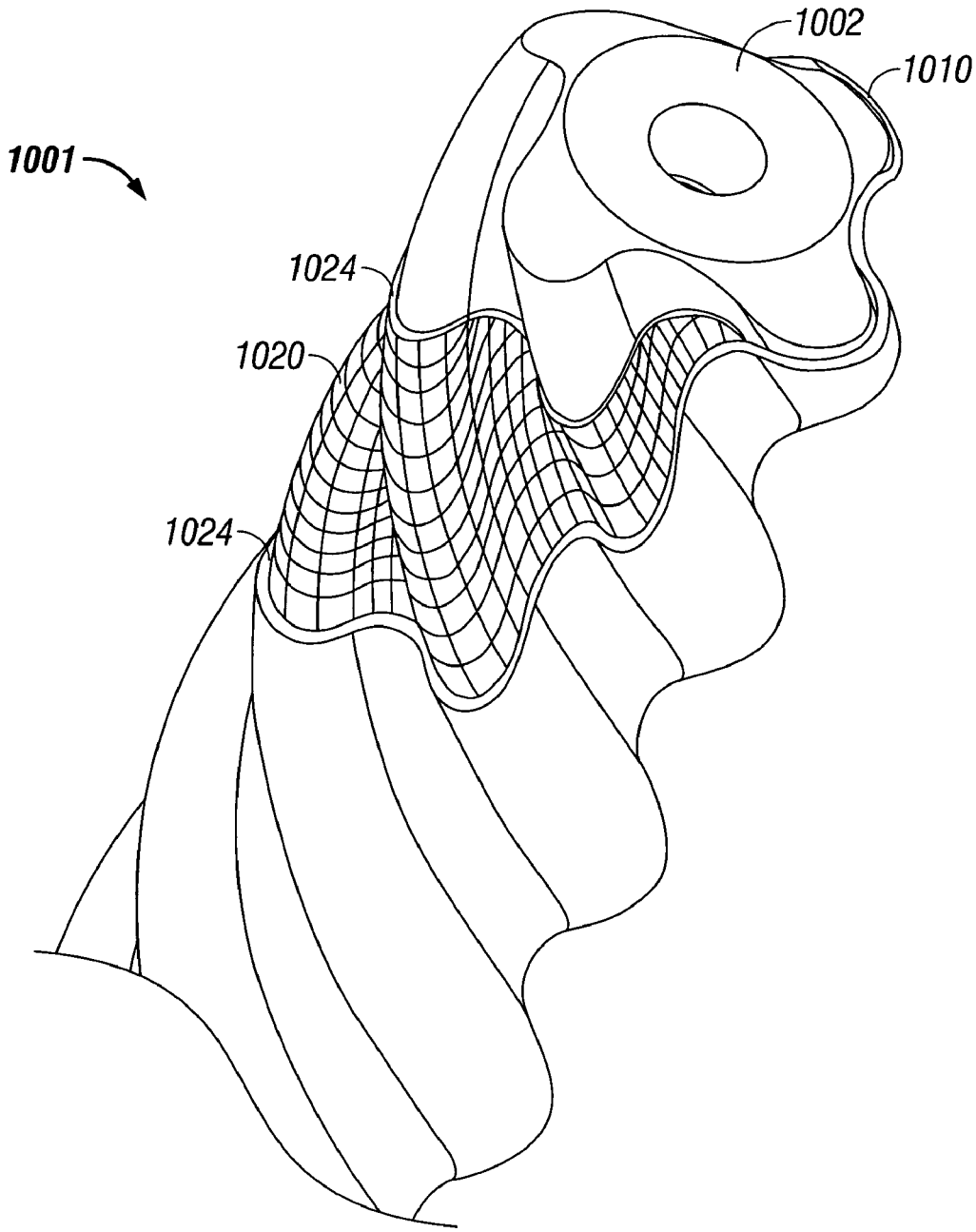
FIG. 10 is a perspective view of a rotor formed from a sleeve disposed on a core with a profiled helical outer surface, wherein the sleeve is a mesh tube encapsulated by a layer of resilient material, according to one embodiment of the invention.

FIG. 10 is a rotor 1001 with a core 1002 disposed within a single layer sleeve 1010. Single layer sleeve 1010 includes a mesh tube 1020 encapsulated by a layer of material 1024. The layer of material 1024 in this embodiment is preferably a resilient material, for example, elastomer or rubber. Mesh tube 1020 can be formed from any material, for example, metal or polymer.

Figure 11:
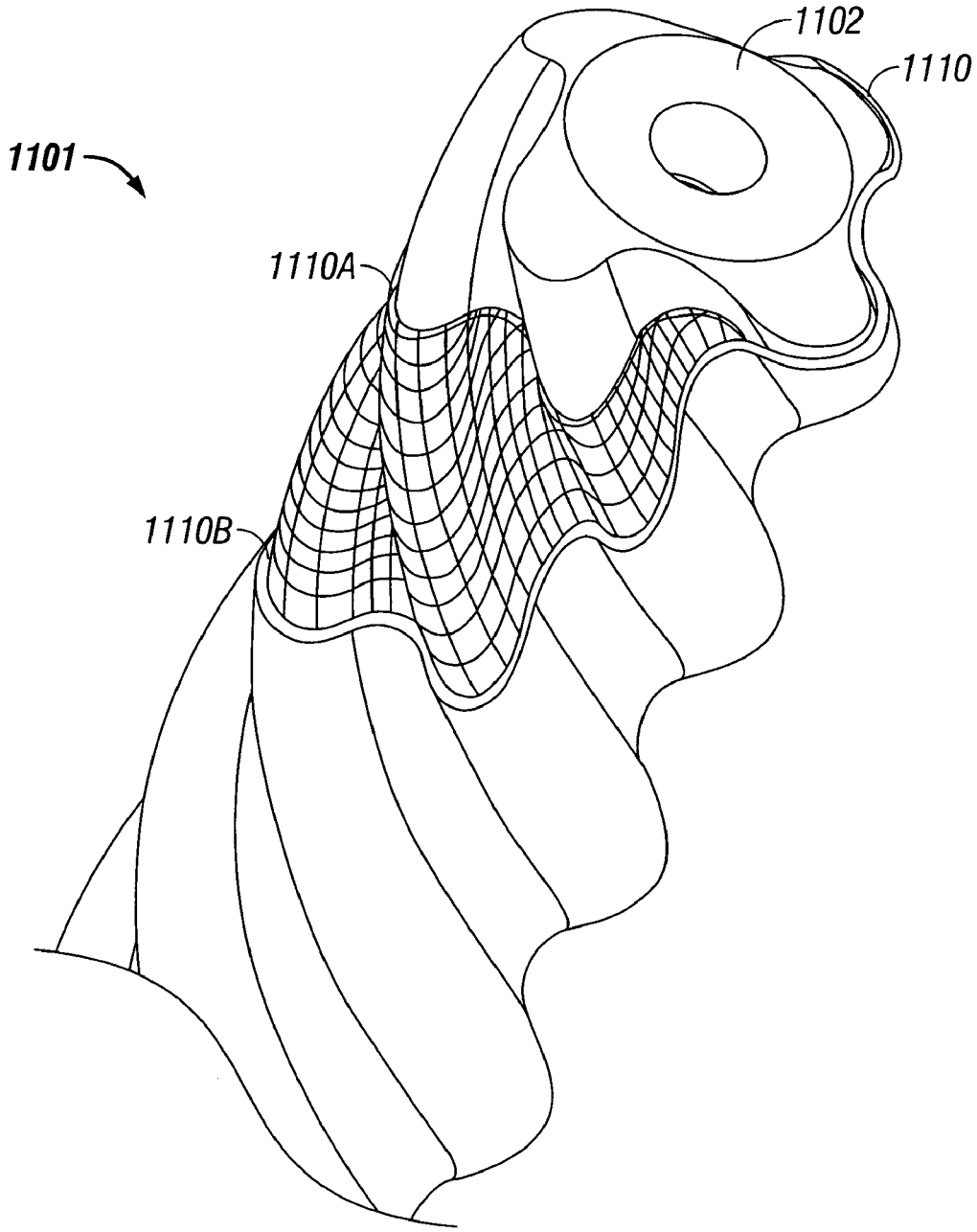
FIG. 11 is a perspective view of a rotor formed from a dual layer sleeve disposed on a core with a profiled helical outer surface, wherein the inner layer is a mesh tube, according to one embodiment of the invention.

FIG. 11 is a rotor 1101 with a core 1102 disposed with a dual layer sleeve 1110, having an inner mesh tube 1110A and outer layer 1110B that is a layer of any material, preferably, a resilient material. The outer layer 1110B of material can be bonded to the mesh tube inner layer 1110A or be threaded onto the mesh tube inner layer 1110A as disclosed above, for example, to be removable by threading so as to not require the chemical, mechanical, or other removal means utilized in the prior art methods of re-lining progressive cavity apparatuses.

Figure 12:
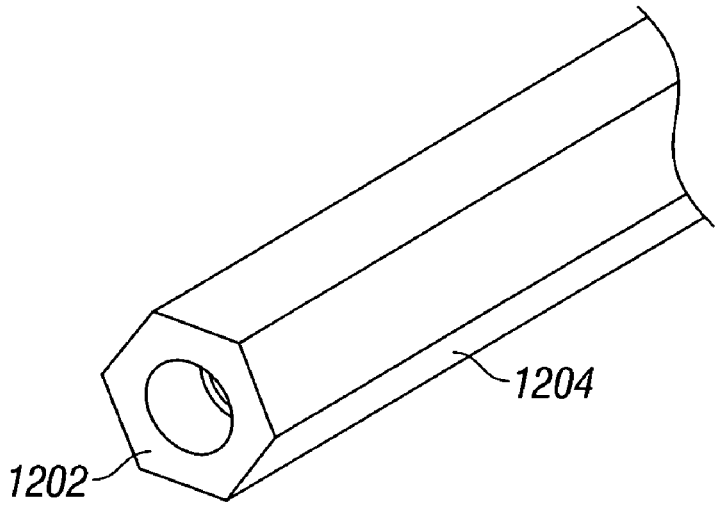
FIG. 12 is a perspective view of a non-helical, unskinned core with a hexagonal transverse cross-section used to form a skinned rotor, according to one embodiment of the invention.

However, a core is not required to have a profiled helical outer surface as shown in the above figures. Outer surface of the core and inner surface of a sleeve can be any configuration. FIG. 12 is a core 1202 with the outer surface 1204 of the core 1202 having a hexagonal transverse cross-section, as opposed to the profiled (e.g., lobed) transverse cross-section of cores in FIGS. 5-8 that form a helical pattern along the length of the cores.

Figure 13:
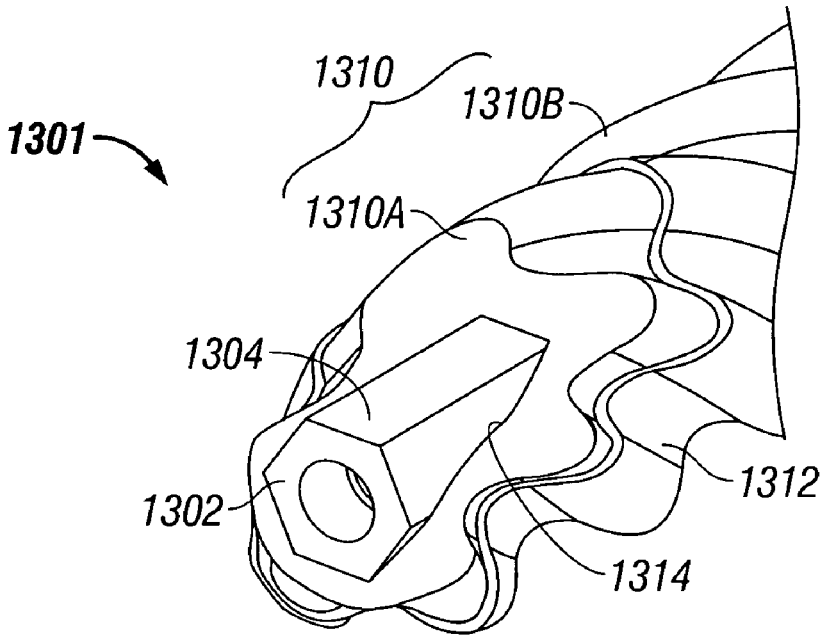
FIG. 13 is a perspective view of a rotor formed from a core with a hexagonal transverse cross-section, the core disposed within a sleeve with a profiled helical outer surface and a longitudinal bore with a hexagonal transverse cross-section, according to one embodiment of the invention.

FIG. 13 is a rotor 1301 formed by inserting a core 1302 into a longitudinal bore 1314 of a sleeve 1310. The core 1302 has an outer surface 1304 with a hexagonal transverse cross-section, and the core is removably received by a longitudinal bore 1314 of the sleeve 1310, the longitudinal bore 1314 also having a hexagonal transverse cross-section. A rotor 1301 can have adjacent sleeve 1310 and core 1302 surfaces (1304, 1314) of substantially the same size. The outer surface 1304 of the core 1302 can be at least slightly smaller in diameter relative to the inner surface of the longitudinal bore 1314 of the sleeve 1310. This allows the sleeve 1310 to be slidably disposed onto the outer surface 1304 of the core 1302, as is discussed further herein. Although sleeve 1310 is shown with an optional second layer 1310B, a sleeve 1310 can be merely the inner layer 1310A. Inner layer 1310A can be molded directly onto core 1302. In one embodiment, the inner layer 1310A, with a profiled helical outer surface, is non-compliant or semi-compliant material. In contrast to a core with a profiled helical outer surface (FIGS. 5-8), the embodiment of FIG. 13 typically will not need relative rotation during assembly as the core 1302 and longitudinal bore 1314 that removably receives the core 1302 do not have a helical form, merely a linear extending hexagonal profile. Although not illustrated, the profile, here a hexagonal profile or cross-section, can be of helical form along the length of the core, for example, similar to the profiled or lobed surface having a helical form along the length of the core in FIG. 5.

Although illustrated with a hexagonal core (1202, 1302) and hexagonal longitudinal bore 1314 in FIGS. 12-13, any configuration of core, and longitudinal bore of a sleeve removably receiving said core, can be utilized. A longitudinal bore of a sleeve and/or an outer surface of a core can be circular (see FIG. 14), non-circular (e.g. ovate), closed figure including curved and straight line segment(s), triangular, rectangular, square, hexagonal, or other polygonal, with respect to a cross-section that is transverse to the longitudinal axis of the core and/or a sleeve. Further, the outer surface of a core and the longitudinal bore of a sleeve removably receiving said core do not have to be the same transverse cross section as long as relative rotation between core and sleeve is impeded by frictional or engagement contact therebetween.

Figure 14:
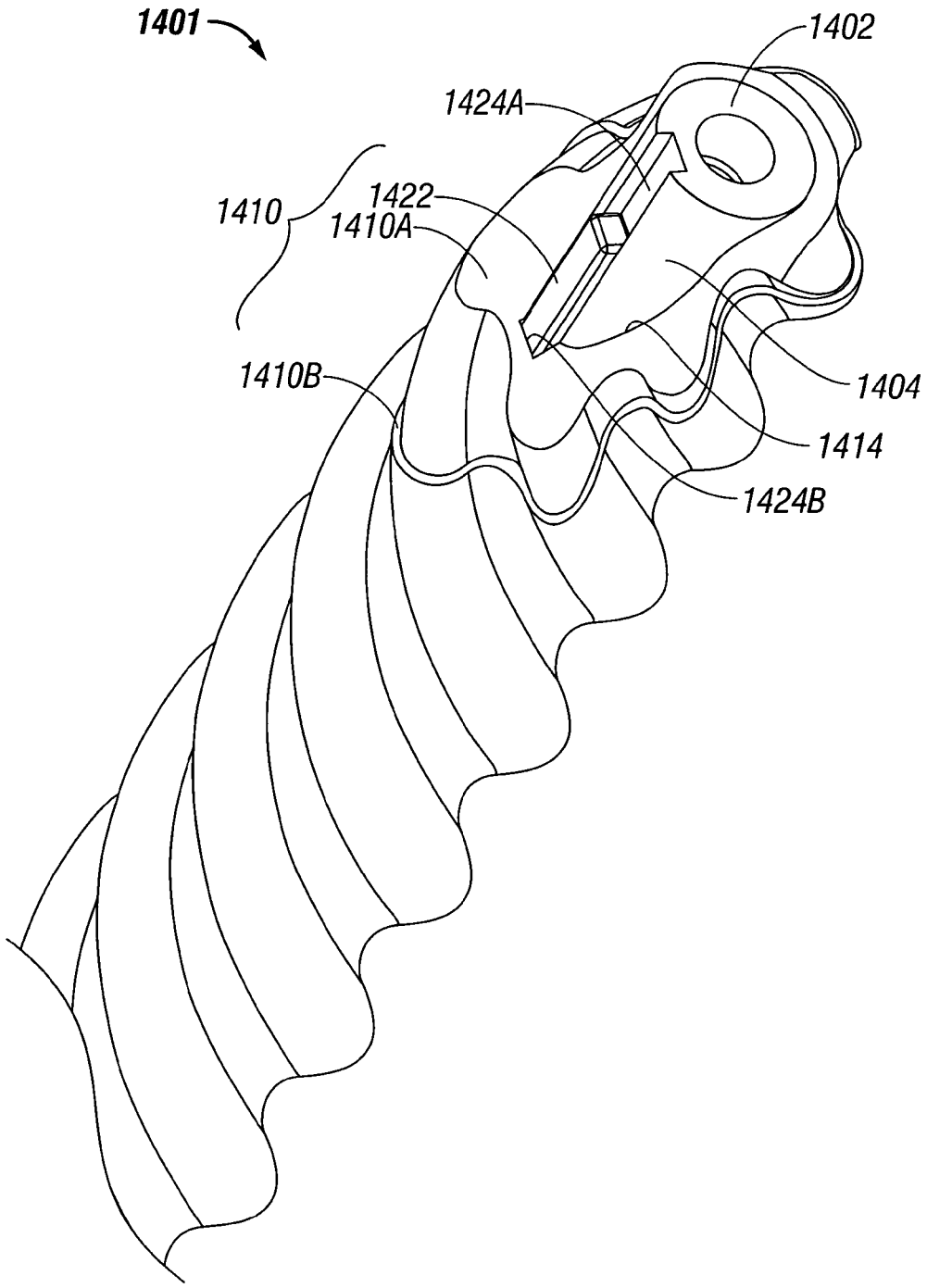
FIG. 14 is a perspective view of a rotor formed from a core with a circular transverse cross-section, the core disposed within a sleeve with a profiled helical outer surface and a longitudinal bore with a circular transverse cross-section, according to one embodiment of the invention.

FIG. 14 is a rotor 1401 formed by inserting a core 1402 into a longitudinal bore 1414 of a sleeve 1410. The core 1402 has an outer surface 1404 with a circular transverse cross-section that is removably received by a longitudinal bore 1414 of the sleeve 1410, the longitudinal bore 1414 having a circular transverse cross-section. A rotor 1401 can have adjacent sleeve 1410 and core 1402 surfaces (1414, 1404) of substantially the same size. The outer surface 1404 of the core 1402 can be at least slightly smaller in diameter relative to the inner surface of the longitudinal bore 1414 of the sleeve 1410, but can be at least slight larger. A sleeve 1410 can be slidably disposed, with no rotation required, onto the outer surface 1404 of the core 1402, as is discussed further herein. If the coefficient of friction between the assembled core 1402 and sleeve 1410 is insufficient to restrict relative rotation therebetween when used in a progressive cavity apparatus, an optional key 1422 can be used.

A first key slot 1424A can be formed in the outer surface 1404 of the core 1402 and a second key slot 1424B formed in an inner surface of the longitudinal bore 1414 of the sleeve 1410. The two key slots (1424A, 1424B) can then be aligned and a key 1422 inserted therein, as is know to one of ordinary skill in the art.

Although not shown, a key 1422 can be formed on (or otherwise attached to) either the outer surface 1404 of the core 1402 or the inner surface of the longitudinal bore 1414 of the sleeve 1410. A respective key slot (1424A, 1424B) can be formed in either the other of the surfaces (e.g., the surface without a key 1422 formed on or attached thereto). A plurality of keys 1422 and respective key slots (1424A, 1424B) can be used without departing from the spirit of the invention. Although not shown, two sets of keys and key slots can be used to create a mechanical lock between a core 1402 and sleeve 1410 to restrict relative rotation therebetween. Although a dual layer (1410A, 1410B) sleeve 1410 is shown, sleeve 1410 can be a single layer or any number of layers without departing from the spirit of the invention. Inner layer 1410A can be molded directly onto core 1402, with or without slot 1424A, slot 1424B, and/or key 1422.

Figure 15:
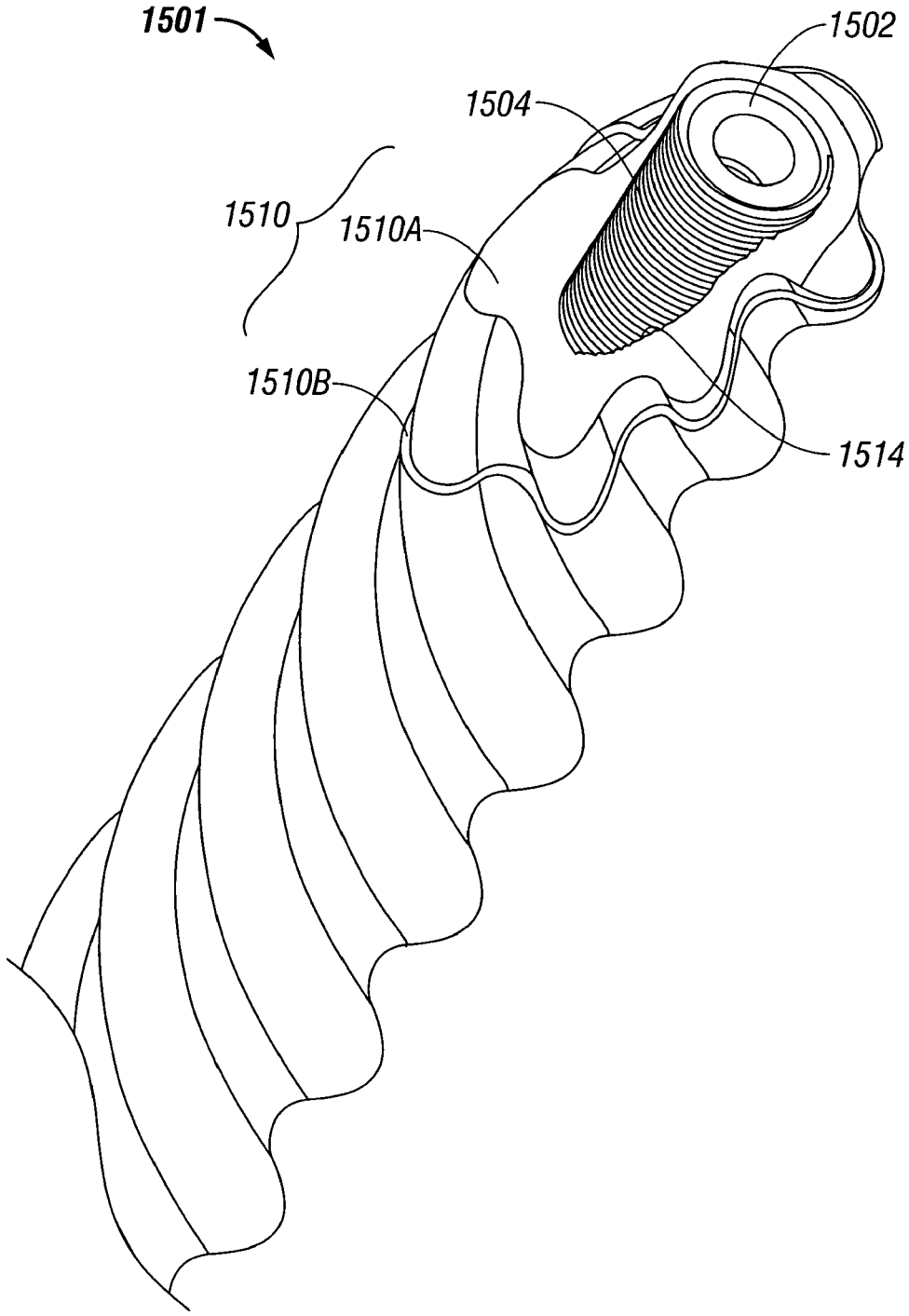
FIG. 15 is a perspective view of a rotor formed from a core with a threaded outer surface threadably engaged to a threaded inner surface of the longitudinal bore of a sleeve, the sleeve having a profiled helical outer surface, according to one embodiment of the invention.

FIG. 15 is another embodiment of a rotor 1501 formed by a core 1502 disposed within a sleeve 1510. Here, the outer surface 1504 of the core 1502 is threadably engaged within the longitudinal bore 1514 of a sleeve 1510. Although the embodiments with profiled helical surfaces forming the engaging surface of the core and sleeve, for example, those in FIGS. 6-11, are referred to as having a core being threaded within a sleeve, the embodiment of FIG. 15 has traditional threaded surfaces as is known in the art. The threaded surfaces preferably have a generally circular transverse cross-section and a relatively high pitch, in contrast to the profiled or lobed (e.g., non-circular) transverse cross-section of the engaging surfaces of FIGS. 6-11. Although a dual layer (1510A, 1510B) sleeve 1510 is shown, sleeve 1510 can be a single layer or any number of layers without departing from the spirit of the invention.

Any combination of the inner surface of the longitudinal bore 1514 of the sleeve 1510 and the outer surface 1504 of the core 1502 can be threaded. Threads can be any type known in the art, for example tapered or box threads. One of the longitudinal bore 1514 of the sleeve 1510 and the outer surface 1504 of the core 1502 can have self-tapping threads and the other of the bore 1514 and the outer surface 1504 of the core 1502 can be non-threaded. Inner layer 1510A can be molded directly onto core 1502, if desired.

Figure 16:
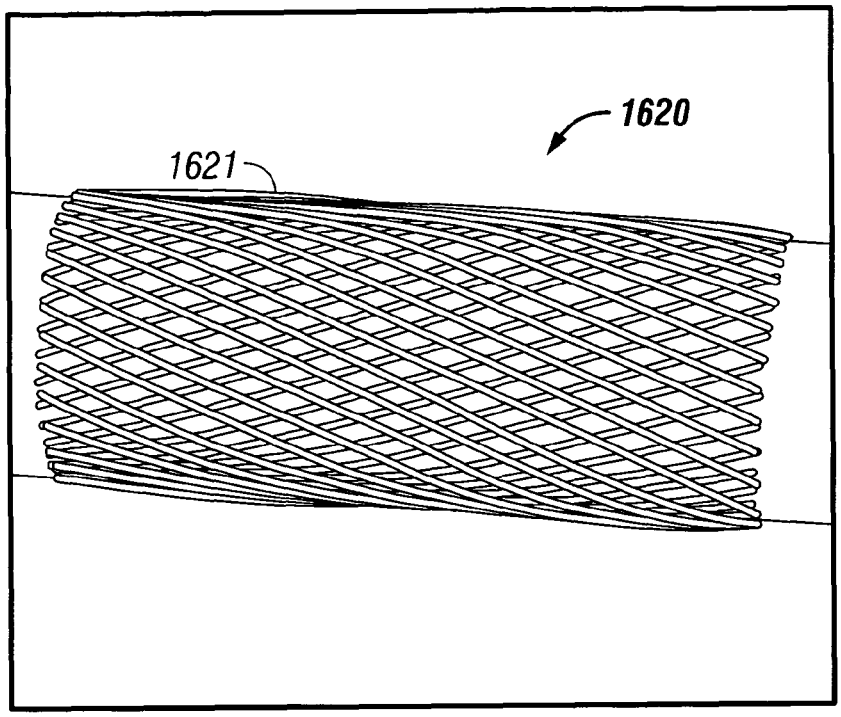
FIG. 16 is a perspective view of a mesh tube used to illustrate the forming of a resilient rotor sleeve, according to one embodiment of the invention.
Figure 17:
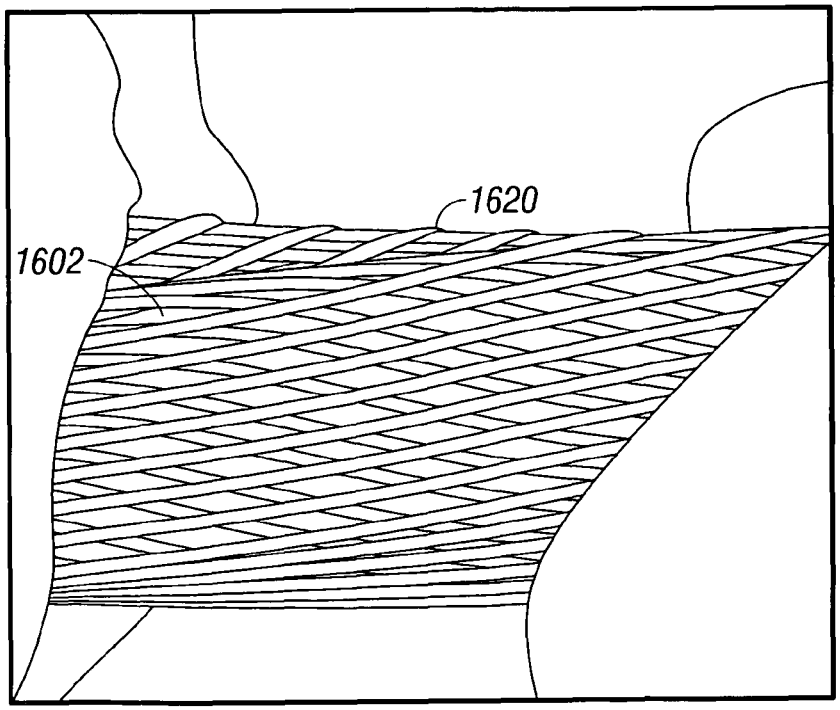
FIG. 17 is a perspective view of a mesh tube disposed around the profiled helical outer surface of a rotor core, for illustration of the forming of a resilient sleeve over a rotor core, according to one embodiment of the invention.
Figure 18:
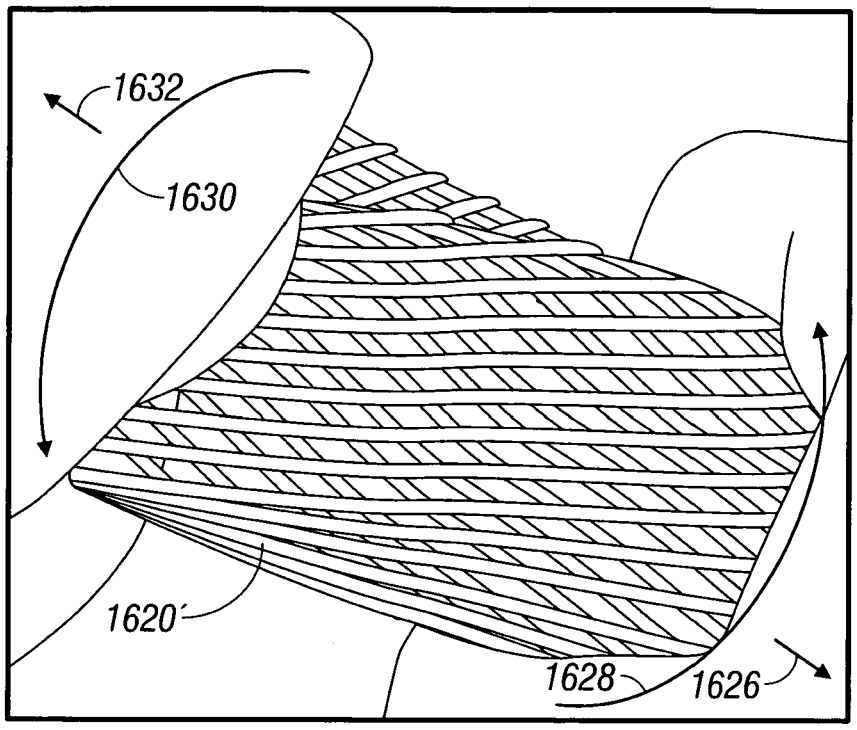
FIG. 18 is a perspective view of a mesh tube conformed to the profiled helical outer surface of a core, according to one embodiment of the invention.

FIGS. 16-18 illustrate a method of forming a tube into a profiled helical tube 1620'. FIG. 16 is a mesh tube 1620 with an annular transverse cross-section, however the tube 1620 can be of solid wall construction. To impart the profiled helical form, the tube 1620, shown as a mesh tube, is disposed over a core 1602 with a profiled helical outer surface as is shown in FIG. 17. In one embodiment, at least one of the cross-helical strands 1621 forming the mesh tube 1620 is substantially parallel to an apex of lobe so as to follow the helical form of the outer surface of the core 1602.

The profiled helical form can be imparted by a combination of a twisting force (1628, 1630) and a tension or pulling force (1626, 1632) on opposing ends of the mesh tube 1620 conforming said tube 1620 against the contours of the profiled helical core 1602. The resulting profiled helical mesh tube 1620' can then be removed if the mesh tube 1620 material is one that will hold the profiled helical form when tension is released from opposing ends of profiled helical mesh tube 1620'. If the profiled helical mesh tube 1620' cannot retain the profiled helical form without further means of adhesion, an adhesive or bonding agent can be added to retain the mesh tube 1620 to the core 1602. An appropriate adhesive can be used to allow the mesh tube 1620 to be removable from the profiled helical outer surface of the core 1602 to enable the reskinning of the core 1602 as needed. The profiled helical mesh tube 1620' can be coated and/or encapsulated with a layer of material, for example elastomer, which can aid in the retention of the profiled helical form.

Twisting (1628, 1630) and/or tension (1626, 1632) can be imparted by any means known in the art. The core 1602 utilized here does not have to be a core used to form a rotor as disclosed above, and can be a mandrel merely used for creating the profiled helical form.

Figure 19:
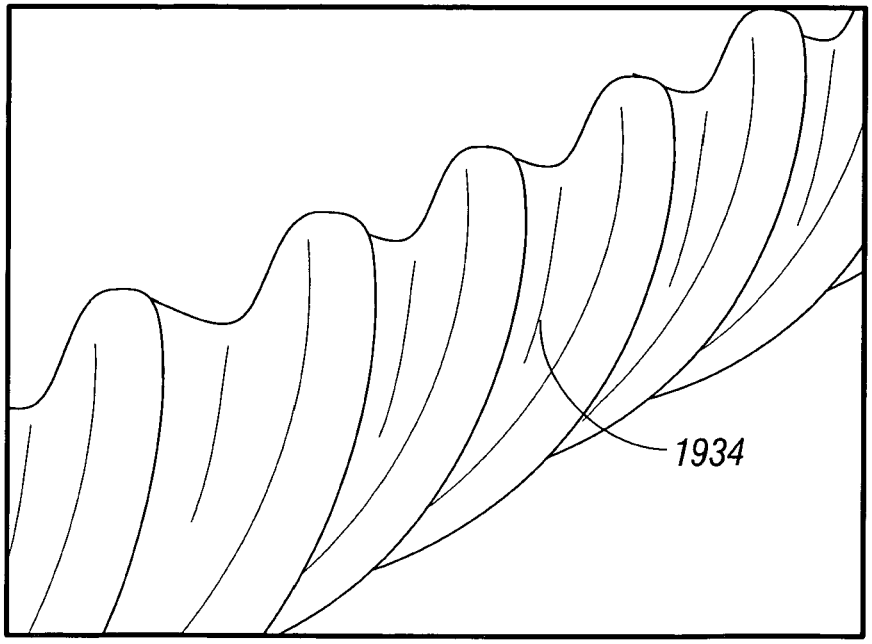
FIG. 19 is a perspective view of the profiled helical outer surface of a sleeve used to form a skinned rotor, according to one embodiment of the invention.

Although FIGS. 16-18 illustrate the imparting of a profiled helical form to a mesh tube, the methods disclosed can be used with any tube, for example, a solid walled tube with an annular transverse cross-section or a circular outer and/or inner surface in its initial form. For example, annular silicone tube 1934, having a circular inner and outer surface in its original state, can have a profiled helical form (e.g., profiled helical inner and outer surface) imparted by this method of tension and rotation, as is shown in FIG. 19. A resilient material tube (e.g., one with an annular transverse cross-section) can have an appropriate softness, for example of about 50 to about 90 durometer. In this embodiment, the tube can be utilized as a removable skin (e.g., sleeve or tubular liner). Profiled helical tube can be formed directly on a profiled helical core or in a profiled helical bore for use as a sleeved rotor or stator, respectively. Profiled helical tube can be formed separately (e.g., on a mandrel by tension and rotation) and disposed onto a rotor core or into a stator bore, for example, if the tube material is sufficient to retain the profiled helical form when the force used to impart the profiled helical form is released. A tube can be bonded to profiled helical core 1602, for example, to help retain the profiled helical form. The opposing ends of a tube can be bonded to a rotor core (or stator bore) to retain the profiled helical form after the step of conforming. Alternatively, after imparting the profiled helical form a tube (e.g., a tube originally having an annular transverse cross-section) can be cured to a state of less resiliency, for example, a level of resiliency sufficient to retain the profiled helical form when the force used to impart the profiled helical form is released. In one embodiment, a resilient material tube can be provided in an at least partially uncured state and can be cured after conforming to a profiled helical mandrel to retain the profiled helical form. The now profiled helical resilient material tube can be threaded into a profiled helical bore to form a skinned stator or threaded onto a profiled helical core to form a skinned rotor.

When selecting a tube (e.g., one with an annular transverse cross-section defined by two concentric circles) to form a skin, the peripheral length (i.e., the length around the perimeter) of a profiled helical bore or profiled helical core is generally not equal to the circular circumference of the largest outer diameter of the profiled helical bore or profiled helical core. For profiled helical cores with 4 or less lobes, the peripheral length is usually less than the circumference measured from the largest outer diameter. For example, a 4-lobe profiled helical core can have a major diameter of 7.39 cm (2.91 in) and a peripheral length of 22.5 cm (8.87 in). A circle having 22.5 cm (8.87 in) circumference has a diameter of 7.16 cm (2.82 in). A tube with a circular bore of this diameter can be stretched in the radial direction when disposed over a profiled helical core (e.g., to form the skin). For a profiled helical sleeve of a rotor, matching, or making substantially similar, the inner peripheral length of the bore of the original tube and the peripheral length of the profiled helical outer surface of a core, can reduce or eliminate any bulging of the tube when disposed on the core.

For a profiled helical core with 5 or more lobes, the peripheral length can be greater than the circumference of the largest outer diameter. For example, an 8-lobe profiled helical core can have a major diameter of 17.9 cm (7.05 in) and a peripheral length of 61.39 cm (24.17 in). A circle having a 61.39 cm (24.17 in) circumference has a diameter of 19.5 cm (7.69 in). A tube with a bore having such an outer diameter can be slid over the core having such a major diameter without any stretching in the radial direction (e.g., to form the skin).

The method of imparting a profiled helical form to a mesh or solid walled tube (e.g., one with an annular transverse cross-section defined by two concentric circles) can be used to form a stator tubular liner. In a stator embodiment (not shown), the method can be substantially the same as recited above, except the mesh or solid walled tube can be inserted into a profiled helical bore and whereas tension (1626, 1632) can be imparted for a rotor sleeve, the tubular liner in a stator embodiment can be compressed. Axial compression of the tube can force the mesh or solid walled tube outwards into contact with the profiled helical bore, while a twisting action can aid in the tubular liner conforming to the lobes in the profiled helical bore. Alternatively, a mesh or solid walled tube can be first formed on a profiled helical mandrel and then inserted (i.e., threaded) into a profiled helical bore. A tube can be cured to retain the profiled helical form, for example, when released from the profiled helical core, profiled helical mandrel, or profiled helical bore.

As can be readily appreciated, a stator can be skinned. A stator can be skinned independent of the use of a skinned rotor in a progressive cavity apparatus. Returning to FIG. 3, a stator 305 can be formed with a skin, here formed by tubular liner 310. Although illustrated as a tube 306, any shape or type of body with a profiled helical bore 308 therethrough can be utilized. Outer surface 316 of tube 306 can be cylindrical as shown or have the profiled helical form 111 shown in FIG. 1. Tube 306 has a longitudinal bore 308 with a profiled helical form. Tubular liner 310 has a profiled helical outer surface 312 and profiled helical inner surface 314. Profiled helical inner surface 314 is the active surface of the stator 305. Profiled helical outer surface 312 of the tubular liner 310 is not required to have the same profiled helical form (e.g., number of lobes, pitch, etc.) as the profiled helical inner surface 314. In one embodiment, the profiled helical outer surface 312 of the tubular liner 310 is substantially similar to the profiled helical bore 308 of the tube 306 into which it will be threaded.

A stator 305 can have adjacent tubular liner 310 and tube 306 surfaces (312, 308) of substantially the same size or adjacent surfaces (312, 308) wherein the profiled helical outer surface 312 of the tubular liner 310 is smaller relative to the profiled helical bore 308 of the tube 306. This allows the tubular liner 310 to be threaded into the profiled helical bore 308 of the tube 306, as is discussed further herein. The thickness of the tubular liner 310 can be variable or constant, as is known by one of ordinary skill in the art.

Tube 306 can be any material, including, but not limited to, metal, polymer, composite fibers, or any combination thereof. Tube 306 can be formed from multiple layers of material without departing from the spirit of the invention. The profiled helical bore 308 of the tube 306 can be imparted or formed by any means know to one of ordinary skill in the art. To create a skinned stator, a tubular liner 310 is disposed within a profiled helical bore 308 of a body.

FIG. 3 is a relatively thin, as compared to the diameter of the profiled helical bore 308, single layer tubular liner 310 disposed in a bore 308 having a profiled helical inner surface. A tubular liner 310 can be any material, including, but not limited to, metal, polymer, composite fibers, or any combination thereof. Tubular liner 310 can be formed from a plurality of layers of similar and/or dissimilar materials without departing from the spirit of the invention. Tubular liner 310 can further be coated with any material if so desired. Tubular liner 310 can be a resilient, non-compliant, semi-compliant, slightly compliant material, or any combination thereof, as defined above. Preferably, the material is sufficient for use in a progressive cavity apparatus and the forces encountered therein.

Tubular liner (e.g., the skin) 310 can be formed by any means known in the art, including, but not limited to, molding a tubular liner with a profiled helical inner and profiled helical outer surface, forming an annular tube into a tubular liner with a profiled helical inner and/or profiled helical outer surface by some mechanical, hydraulic, and/or pneumatic means, or extruding a tubular liner with a profiled helical inner and profiled helical outer surface. One method of forming a tubular liner, or sleeve, with a profiled helical inner and profiled helical outer surface by extrusion is described in patent application U.S. Ser. No. 11/496,675 titled "Method and Apparatus for Extrusion of Profiled Helical Tubes", herein incorporated by reference. If so desired, a bonding agent or adhesive can be utilized to affix a portion of tubular liner 310 to a portion of the profiled helical bore 308 of a stator tube 306. A profiled helical skin (e.g., sleeve or tubular liner) can be formed by conforming a tube, for example, an at least partially uncured tube, to a profiled helical core and then curing the conformed tube to a state where the tube retains the profiled helical form of the core when the core is removed. A tubular liner can be circumferentially continuous.

Figure 20:
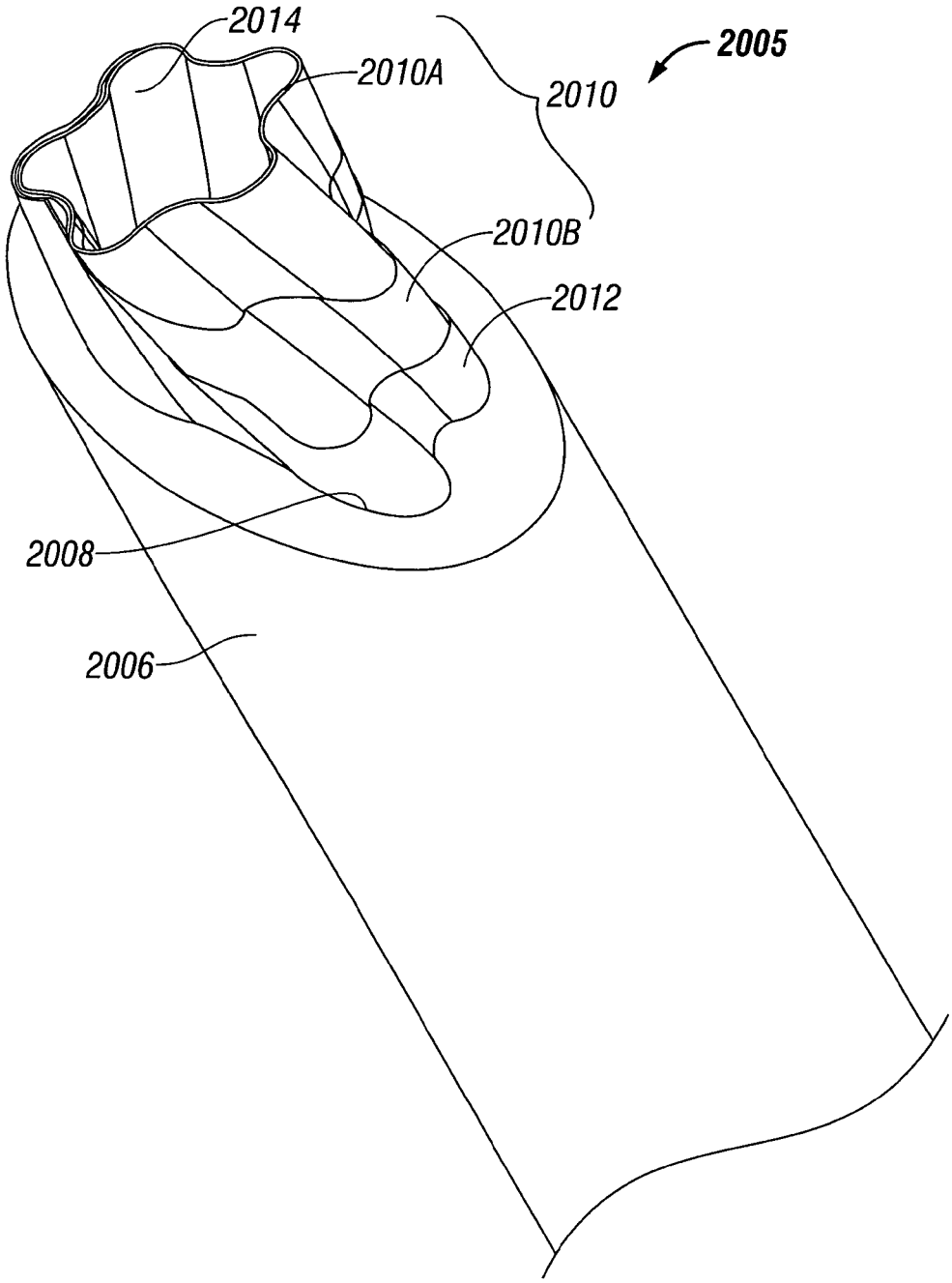
FIG. 20 is a perspective view of a stator formed from a dual layer tubular liner disposed within a profiled helical bore of a tube, according to one embodiment of the invention.

FIG. 20 is a stator 2005 with a dual layer tubular liner 2010 formed from an inner layer 2010A and an outer layer 2010B. Tubular liner 2010 has a profiled helical inner surface 2014 and profiled helical outer surface 2012. Either layer (2010A, 2010B) of the tubular liner 2010 can be of variable or constant thickness. The dual layer tubular liner 2010 is disposed in a profiled helical bore 2008 of a tube 2006. In one embodiment, the tube 2006 is a non-complaint material, such as metal. A tubular liner 2010 can be formed from multiple layers of the same material with similar or varying durometer measurements. A tubular liner 2010 can be a combination of different layers of material, for example, outer layer 2010B can be a non-compliant material, for example, metal, and inner layer 2010A can be a resilient material, for example, elastomer or rubber. In another embodiment, outer layer 2010B can be a semi-compliant material, for example, a polymer, and inner layer 2010A can be a resilient material, for example, elastomer or rubber. In yet another embodiment, outer layer 2010B can be a resilient material, for example, elastomer or rubber, and inner layer 2010A can be a slightly compliant material, for example, a thin layer of silicon or polytetrafluoroethylene. Outer layer 2010B of a skin can be a non-compliant material, for example, metal, and inner layer 2010A can be a slightly compliant material, for example, a thin layer of silicon or polytetrafluoroethylene. Multiple layers of material can be joined together to form a tubular liner, or multiple tubular liners can be threadably disposed within each other circumferentially (e.g. to form a skin).

Figure 21:
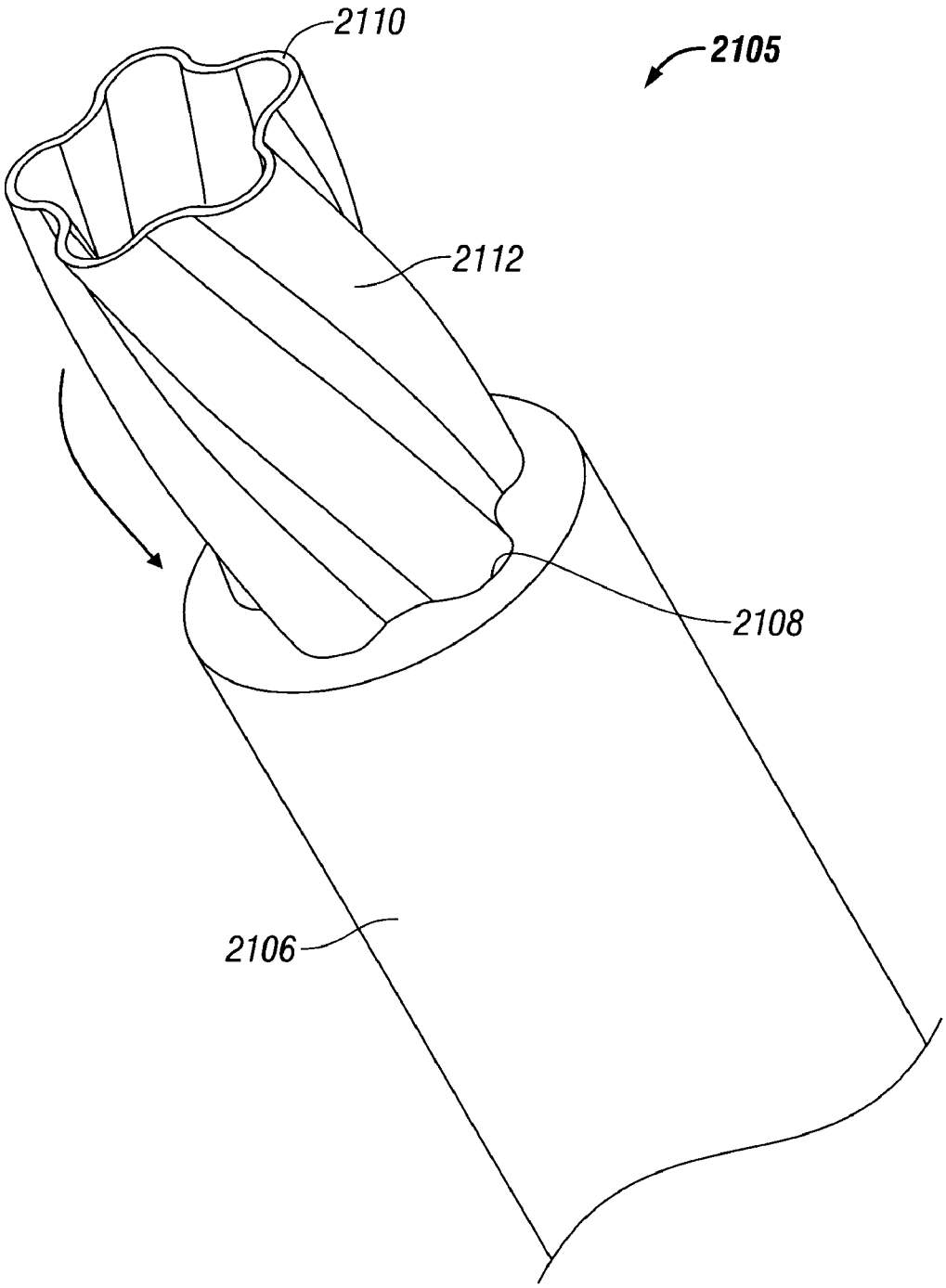
FIG. 21 is an exploded view of a tubular liner, with a profiled helical inner and profiled helical outer surface, being threaded into the profiled helical bore of a tube, according to one embodiment of the invention.

FIG. 21 illustrates a method of skinning a stator 2105 by assembling a tube 2106 and a tubular liner 2110. By providing a tubular liner 2110 with a profiled helical outer surface 2112 of substantially the same profiled helical geometry, or form, as the profiled helical bore 2108 of the tube 2106, tube 2106 can removably receive the tubular liner 2110. To form the stator 2105, the tubular liner 2110 is threaded into the profiled helical bore 2108. One method is to engage an end of the profiled helical outer surface 2112 of the tubular liner 2110 into the profiled helical bore 2108 of the tube 2106. In one embodiment, the profiled helical outer surface 2112 of the tubular liner 2110 in an un-installed state is sized relative to the profiled helical bore 2108 of the tube 2106 so as to allow a slight gap therebetween. In such an embodiment, the tubular liner 2110 can be threaded into the profiled helical bore 2108 so that the profiled helical outer surface 2112 of the tubular liner 2110 engages the profiled helical bore 2108 of the tube 2106. This allows the tubular liner 2110 to be disposed within the profiled helical bore 2108 in a manner akin to threading a bolt into a nut.

The assembly step can include providing relative rotation and/or axial displacement between the tubular liner 2110 and profiled helical bore 2108. An adhesive or other means of affixing the tubular liner 2110 to the profiled helical bore 2108 can be used. If there is a non-frictional fit (e.g., a gap therebetween) of the adjacent profiled helical surfaces (2108, 2112) when assembled, relative rotation between the profiled helical bore 2108 of the tube 2106 and tubular liner 2110 can be impeded by the interaction of the helical surfaces (2108, 2112). In such an embodiment, if relative axial displacement is restricted, the tubular liner 2110 is rotationally retained relative to the profiled helical bore 2108. Relative axial displacement can be restricted, for example, with a bearing 415 of a progressive cavity apparatus as described in reference to FIG. 4 and/or restricted with welding or adhesives, for examples, between the liner 2110 and profiled helical bore 2108 at the ends. A tubular liner can be frictionally retained against the profiled helical bore, for example, by being slightly oversized, as is discussed in U.S. patent application Ser. No. 11/385,946 filed Mar. 21, 2006 titled "Downhole Motor Seal and Method", previously incorporated by reference. In any manner, the tubular liner is removable as compared to the profiled helical inner surface of a prior art rotor, which is typically a solid piece of metal or an injection molded layer of elastomer.

When desired, the tubular liner itself can be rapidly replaced, for example as compared to the typical manner of recoating the profiled helical bore of a stator with chrome or re-injecting with elastomer. A first sleeve 2110 can be slidably disposed out of the profiled helical bore 2108 in the threaded helical manner discussed above, and a new sleeve threaded into the profiled helical bore 2108. Similarly, a tube 2106 can be unthreaded from a tubular liner 2110 and said tubular liner 2110 threaded into a second tube with profiled helical bore.

Although the assembly step is described in reference to a single layer embodiment of a replaceable tubular liner, a tubular liner with a plurality of layers can be used without departing from the spirit of the invention. In a dual layer embodiment, for example as in FIG. 20, an inner layer and outer layer can be joined before being threaded into the profiled helical bore, or the outer layer can be threaded into the profiled helical bore followed by the inner layer being threaded into the outer layer and tube sub-assembly. In such an embodiment, any combination of the tube, inner layer of the tubular liner, and/or outer layer of the tubular liner can be replaced as desired.

Figure 22:
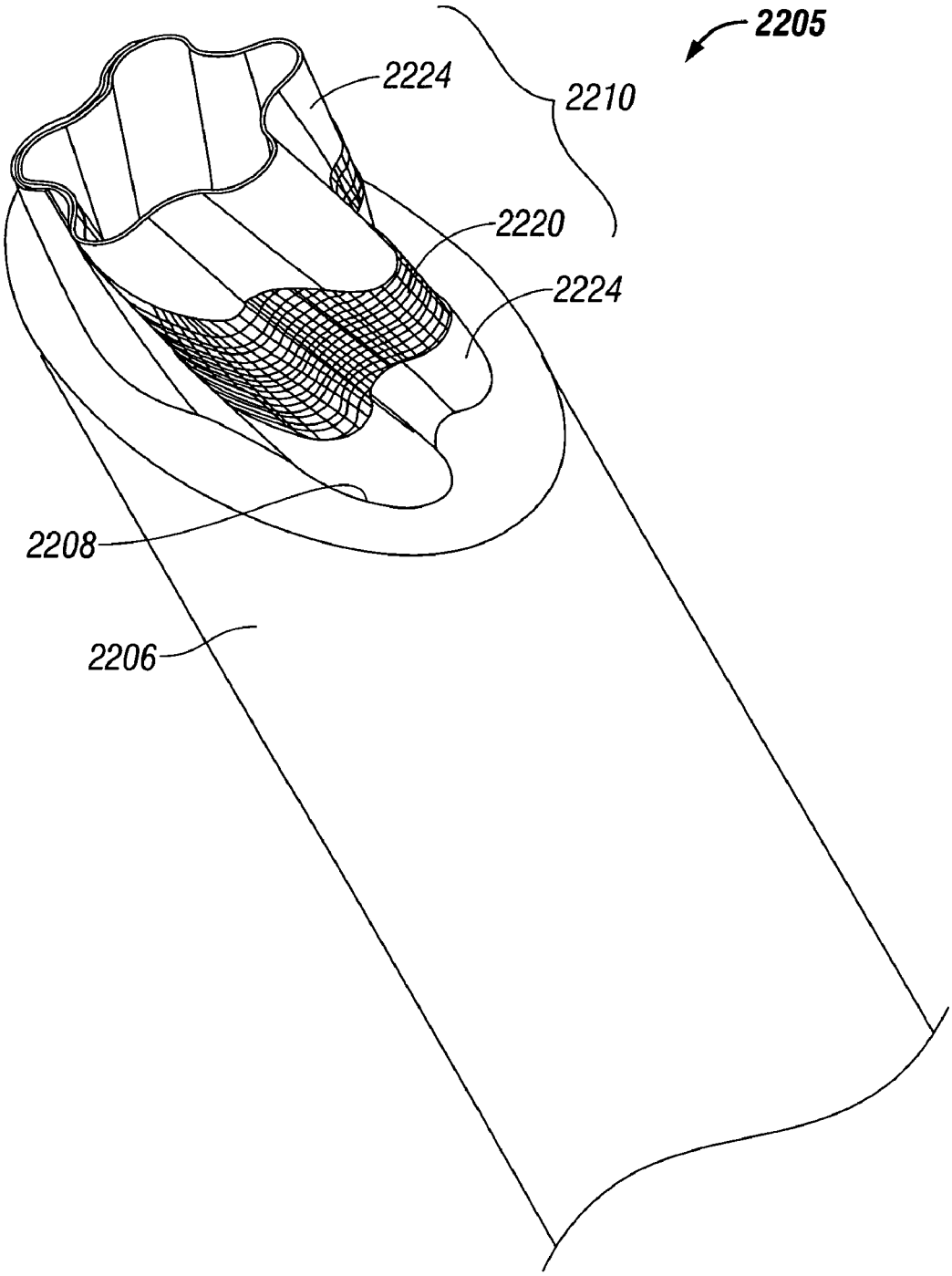
FIG. 22 is a perspective view of a stator formed from a tubular liner, with a profiled helical inner and outer surface, disposed within a profiled helical bore of a tube, wherein the tubular liner is a mesh tube encapsulated by a layer of resilient material, according to one embodiment of the invention.

FIG. 22 is a stator 2205 with a single layer tubular liner 2210 removably received in a profiled helical bore 2208 of a tube 2206. Single layer tubular liner 2210 includes a mesh tube 2220 encapsulated by a layer of material 2224. The layer of material 2224 in this embodiment in preferably a resilient material, for example, elastomer or rubber. Mesh tube 2220 can be formed from any material, for example, metal or polymer.

Figure 23:
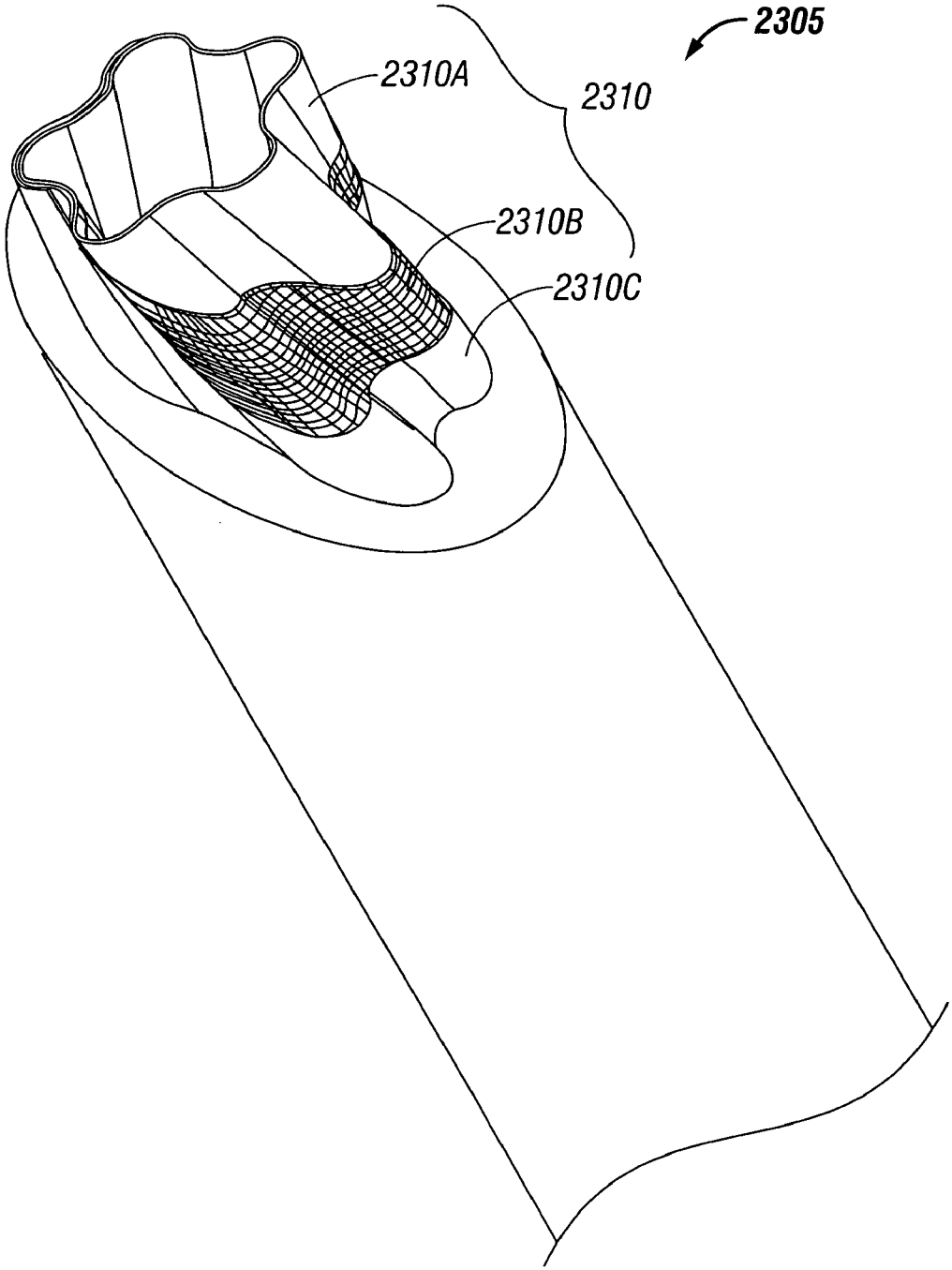
FIG. 23 is a perspective view of a stator formed from a dual layer tubular liner disposed within a profiled helical bore of a tube, wherein the outer layer is a mesh tube, according to one embodiment of the invention.

FIG. 23 is a stator 2305 with a dual layer tubular liner 2310 removably received in a profiled helical bore of a tube. Dual layer tubular liner 2310 has an outer mesh tube 2310B and inner layer 2310A that is a layer of any material, preferably, a resilient material. The inner layer 2310A of material can be bonded to the mesh tube outer layer 2310B or be threaded onto the mesh tube outer layer 2310B as disclosed above, for example, to be removable by threading so as to not require the chemical, mechanical, or other removal means utilized in the prior art methods of re-lining progressive cavity apparatuses. Optional third layer 2310C of tubular liner is shown, but not required.

However, a stator tube skinned with a tubular liner is not required to have a profiled helical tube bore as shown in the above figures. Longitudinal bore of the tube and outer surface of a tubular liner can be any configuration. Stator 2405 in FIG. 24 is a tube 2406 where the transverse cross-section of the longitudinal bore 2408 is hexagonal, as opposed to the profiled, or lobed, transverse cross-section of tube bores in FIGS. 3 and 20-23 that form a helical pattern along the length of the bore.

The tubular liner 2410 has an inner surface 2414 with a profiled helical form and an outer surface 2412 with a hexagonal transverse cross-section. The tubular liner 2410 is removably received by a longitudinal bore 2408 of the tube 2406, the longitudinal bore 2408 having a hexagonal transverse cross-section. A stator 2405 can have adjacent tube 2406 and tubular liner 2410 surfaces (2408, 2412) of substantially the same size, preferably where the inner surface 2408 (e.g. longitudinal bore) of the tube 2406 is at least slightly larger relative to the outer surface 2412 of the tubular liner 2410. This allows the tubular liner 2410 to be slidably disposed into the longitudinal bore 2408 of the tube 2406, as is discussed further herein. Although tubular liner 2410 is shown with an optional second layer 2410A, a tubular liner 2410 can be merely the outer layer 2410B. In one embodiment, the outer layer 2410B, with a profiled helical inner surface, is non-compliant or semi-compliant material. In contrast to a stator tube with a profiled helical bore (FIGS. 3 and 20-23), this embodiment typically will not need relative rotation during assembly as the outer surface 2412 of the tubular liner 2410 and longitudinal bore 2408 that removably receives the tubular liner 2410 do not have a helical form, merely a linear extending hexagonal profile. Although not illustrated, the profile, here a hexagonal profile or cross-section, can be of helical form along the length of the core, for example, as the profiled, or lobed, cross-section is of helical form along the length of the core in FIG. 3. Outer layer 2410B can be molded directly inside longitudinal bore 2408 of the tube 2406, if desired.

Figure 24:
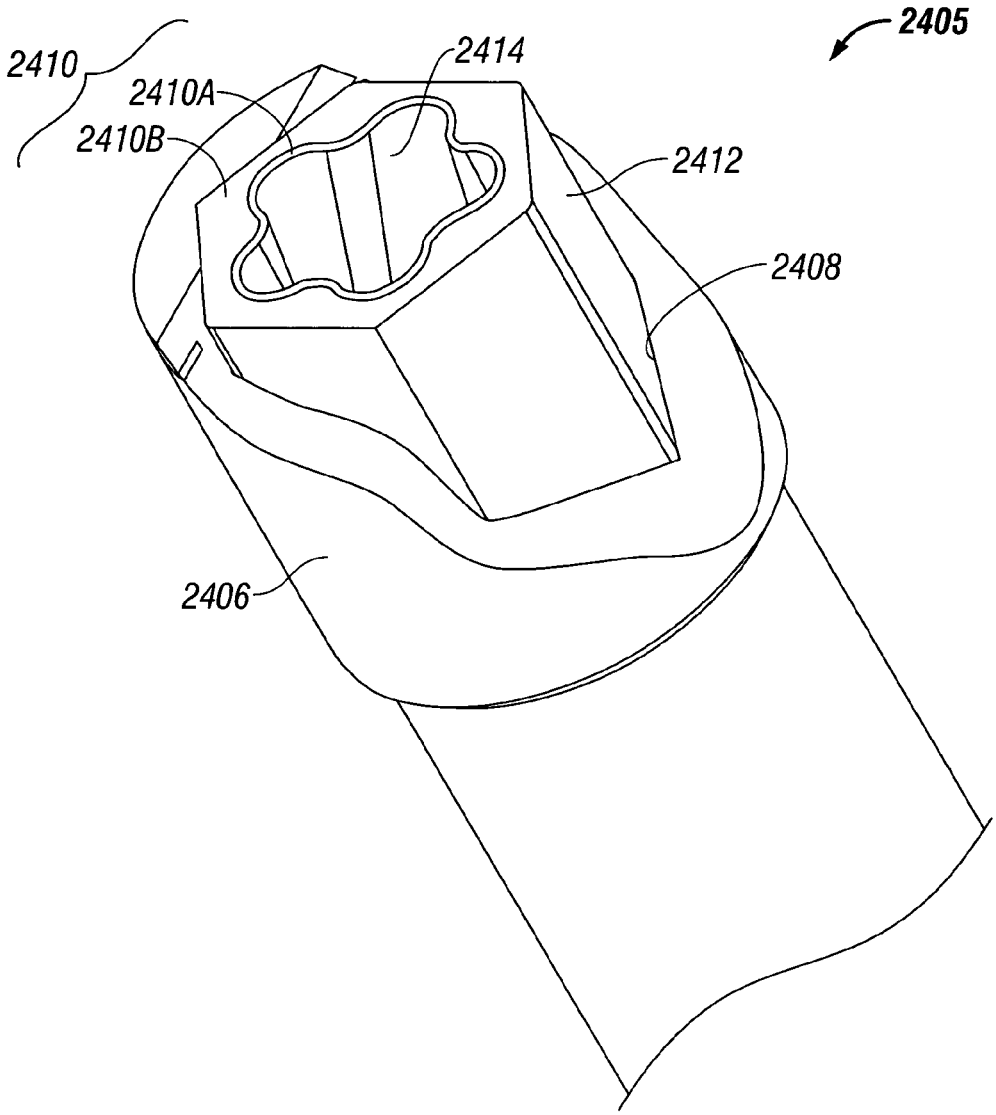
FIG. 24 is a perspective view of a stator formed from a tubular liner with a profiled helical inner surface disposed within a longitudinal bore of a tube, an outer surface of the tubular liner having a hexagonal transverse cross-section and the longitudinal bore having a hexagonal transverse cross-section, according to one embodiment of the invention.

Although illustrated with a hexagonal outer surface 2412 of tubular liner 2410 and a hexagonal longitudinal bore 2408 in FIG. 24, any configuration of tubular liner, and longitudinal bore of a body removably receiving said tubular liner, can be utilized. A longitudinal bore of a tube and/or an outer surface of a tubular liner can be circular (see FIG. 25), non-circular (e.g. ovate), closed figure including curved and straight line segment(s), triangular, rectangular, square, hexagonal, or other polygonal, with respect to a cross-section that is transverse to the longitudinal axis of the tubular liner and/or a longitudinal bore. Further, the outer surface of a tubular liner and the longitudinal bore of a tube removably receiving said tubular liner do not have to be the same transverse cross section as long as relative rotation between tubular liner and longitudinal bore of the tube is impeded by frictional contact therebetween.

Figure 25:
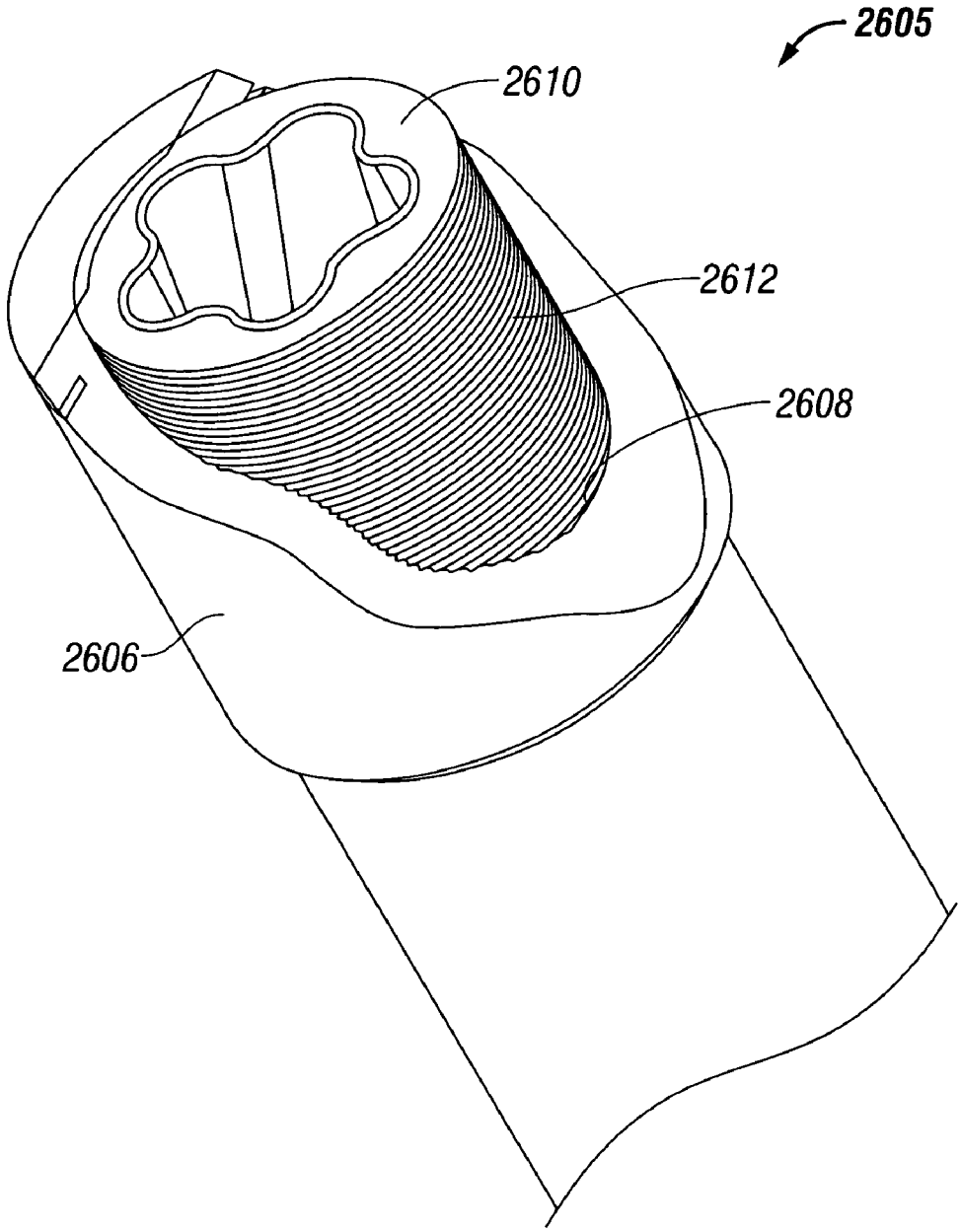
FIG. 25 is a perspective view of a stator formed from a tubular liner with a profiled helical inner surface disposed within a longitudinal bore of a tube, an outer surface of the tubular liner having a circular transverse cross-section and the longitudinal bore having a circular transverse cross-section, according to one embodiment of the invention.

FIG. 25 is a stator 2505 formed by inserting a tubular liner 2510 into a longitudinal bore 2508 of a tube 2506. Tubular liner 2510 can be a single layer or a plurality of layers of material (not shown), for example as tubular liner 2410 includes dual layers (2410A, 2410B) in FIG. 24. The tubular liner 2510 has an outer surface 2512 with a circular transverse cross-section that is removably received by a longitudinal bore 2508 of the tube 2506, the longitudinal bore 2508 having a circular transverse cross-section. A stator 2505 can have adjacent tubular liner 2510 and tube 2506 surfaces (2512, 2508) of substantially the same size, preferably where the outer surface 2512 of the tubular liner 2510 is at least slightly smaller in diameter relative to the inner surface of the longitudinal bore 2508 of the tube 2506. This allows the tubular liner 2510 to be slidably disposed, or inserted, into the longitudinal bore 2508 of the tube 2506, as is discussed further herein. If the coefficient of friction between the assembled tube 2506 and tubular liner 2510 is not sufficient for use in a progressive cavity apparatus, an optional key 2522 can be used.

Two key slots (2524A, 2524B) can be used to create a mechanical lock between an outer surface 2512 of a tubular liner and a tube 2506 to restrict relative rotation therebetween. A first key slot 2524A can be formed in the outer surface 2512 of the tubular liner and a second key slot 2524B formed in an inner surface of the longitudinal bore 2508 of the tube 2506. The key slots can then be aligned and a key inserted therein, as is know to one of ordinary skill in the art.

Although not shown, a key 2522 can be formed on (or otherwise attached to) either the outer surface 2512 of the tubular liner or the inner surface of the longitudinal bore 2508 of the tube 2506. A respective key slot (2524A, 2524B) can be formed on the other of the surfaces (e.g., the surface without a key 2522 formed on or attached thereto). A plurality of keys 2522 and respective key slots (2524A, 2524B) can be used without departing from the spirit of the invention. The tubular liner can be molded directly inside longitudinal bore 2508 of the tube 2506, with or without slot 2524A, slot 2524B, and/or key 2522, if desired.

Figure 26:
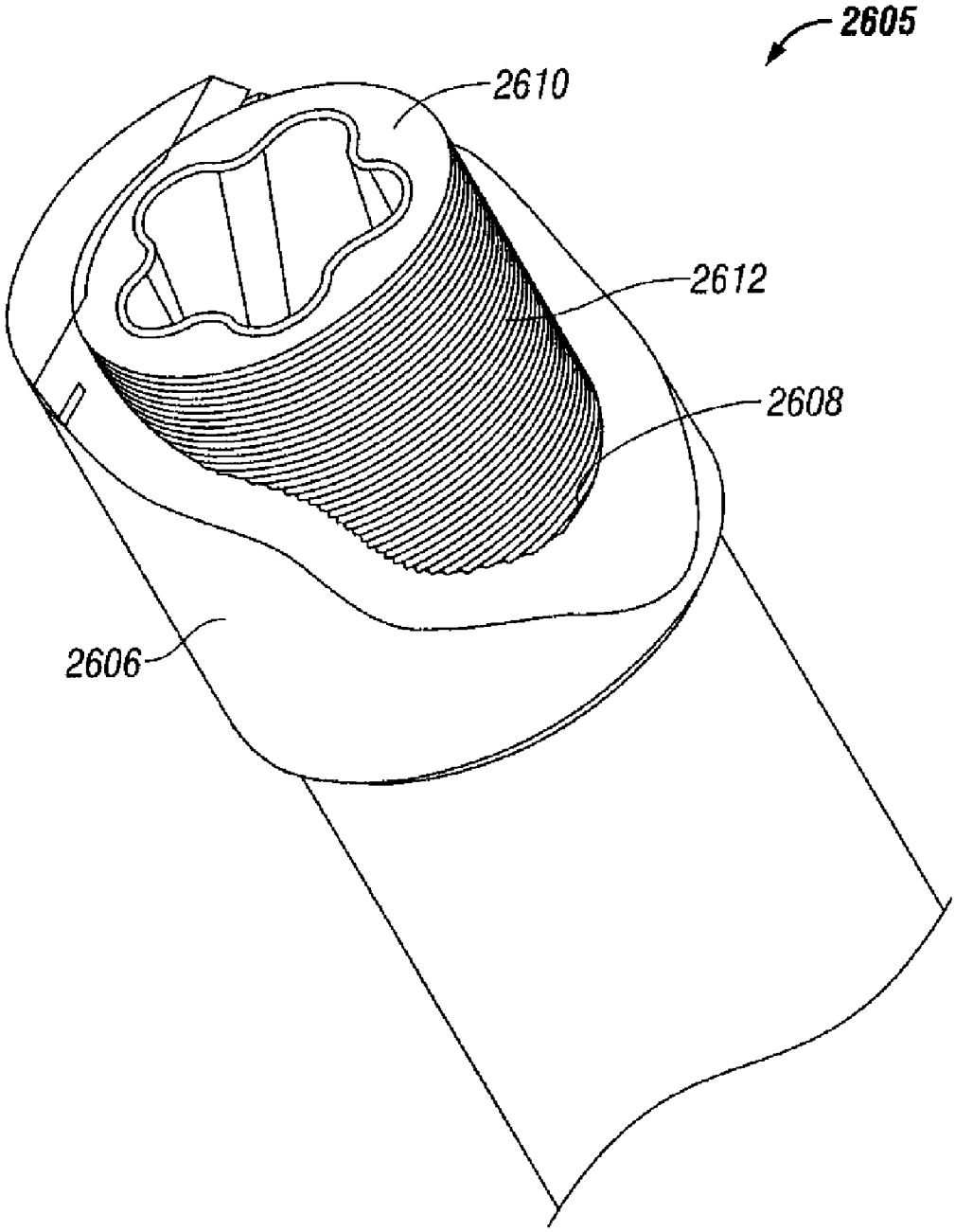
FIG. 26 is a perspective view of a stator formed from a tubular liner with a threaded outer surface threadably engaged to a threaded inner surface of the longitudinal bore of a tube, the tubular liner having a profiled helical inner surface, according to one embodiment of the invention.

FIG. 26 is another embodiment of a stator 2605 formed by a tubular liner 2610 disposed within a longitudinal bore 2608 of a tube 2606. Here, the outer surface 2612 of the tubular liner 2610 is threadably engaged within the longitudinal bore 2608 of a tube 2606. Tubular liner 2610 can be a single layer (as shown) or a plurality of layers of material. A second tubular liner (not shown), preferably with a profiled helical outer and a profiled helical inner surface, can be inserted into the profiled helical bore of the tubular liner 2610 with a threaded outer surface 2612. Although the embodiments with profiled helical surfaces forming the engaging surface of the longitudinal bore and tubular liner, for example, those in FIGS. 3 and 20-24, are referred to as having a core being threaded within a sleeve, the embodiment of FIG. 26 has traditional threaded surfaces as is known in the art. The threaded surface (2608, 2612) preferably has a generally circular transverse cross-section and a relatively high pitch (e.g., short pitch length), in contrast to the profiled, or lobed, transverse cross-section of the engaging surfaces of FIGS. 3 and 20-24.

Either or both of the inner surface of the longitudinal bore 2608 of the tube 2606 and the outer surface 2612 of the tubular liner 2610 can be threaded. Threads can be any type known in the art, for example tapered or box threads. One of the longitudinal bore 2608 of the tube 2606 and the outer surface 2612 of the tubular liner 2610 can have self-tapping threads and the other of the longitudinal bore 2608 and the outer surface 2612 of the tubular liner 2610 can be non-threaded. Tubular liner 2610 can also be molded directly inside the threaded longitudinal bore 2608 of the tube 2606, if desired.

As an additional benefit, the skinned rotor and skinned stator embodiments can be combined to form a totally interchangeable progressive cavity apparatus. For example, by utilizing a rotor with a non-helical core as in FIG. 13-14 or threaded core as in FIG. 15 and a stator tube with a non-helical bore as in FIGS. 24-25 or threaded bore as in FIG. 26, the active surfaces (e.g., the inner profiled helical surface of the stator and the outer profiled helical surface of the rotor) can be replaceable, for example, to change, pitch, number of lobes, etc., by re-skinning with an appropriate set of stator skin and rotor skin. This can allow, for example, the power section of a progressive cavity pump to be changed in the field to provide a desired pump power. This interchangeability can also be achieved with a skinned rotor having a core with a profiled helical outer surface (e.g., 201 in FIG. 2) and skinned stator having a profiled helical bore (e.g., 305 in FIG. 3) if so desired as the active surfaces of each skin do not have to be the same form and geometry as the engaged surfaces (e.g., the surface of an installed sleeve that contacts the core of a rotor and the surface of an installed tubular liner that contacts the longitudinal bore of a tube for a stator).

Figure 27:
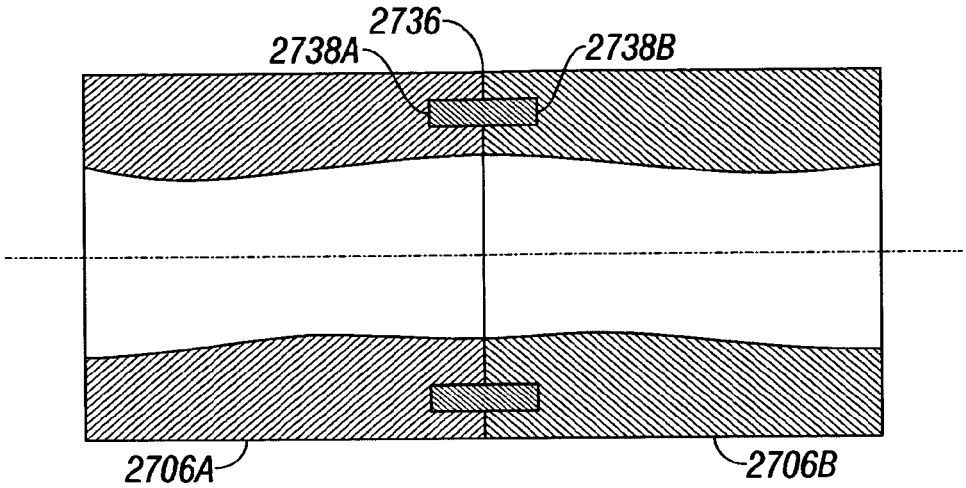
FIG. 27 is a cross-sectional view of tube sections with profiled helical bores aligned by a plurality of dowel pins disposed in respective dowel pin cavities, prior to threading of a tubular liner to form a stator, according to one embodiment of the invention.

As discussed above, a skin can allow discontinuous lengths of a profiled helical surface of a rotor and/or stator to be used in a progressive cavity apparatus. In typical use, a discontinuity (e.g., a gap or crack) in a stator or rotor or between sections of a stator or rotor, can make the stator or rotor unsuitable for used in a progressive cavity apparatus due to leaks, etc. A stator tube formed from discontinuous sections of tube is shown in FIG. 27, preferably with longitudinal bores that can be aligned to form a substantially continuous profiled helical bore. A plurality of tube sections 2706A and 2706B, each with a profiled helical bore of preferably the same geometry (pitch, lobe number, diameter, etc.), can be abutted and/or joined in appropriate configuration to create a substantially continuous profiled helical bore (e.g., there can be a gap) and then skinned with a tubular liner (not shown) to form a continuous profiled helical bore.

Tube sections (2706A, 2706B) can be joined and/or aligned by any means known in the art, and can further be housed in a cylindrical bore of a body (e.g., 418 in FIG. 4). The profiled helical bores of the tube sections (2706A, 2706B) are preferably aligned so as to align the profiled helical bores to allow the disposition of a tubular liner therein. First tube section 2706A has at least one dowel pin cavity 2738A in an end of the tube wall and a respective dowel pin cavity 2738B in the end of the second tube section 2706B wall. A set of dowel pin cavities (2738A, 2738B) can be formed so as to align the profiled helical bores of the tube sections (2706A, 2706B) when a dowel pin 2736 is inserted into the larger cavity formed by said dowel pin cavities (2738A, 2738B) when abutting. Dowel pin 2736, which can form a friction fit in either or both of said dowel pin cavities (2738A, 2738B), is then inserted between the two tube sections (2706A, 2706B) so as to align the tube sections when the ends are adjacent as shown. A plurality of dowel pins 2736 and respective dowel pin cavities (2738A, 2738B) can be used to align any number of tube sections without departing form the spirit of the invention. After alignment, a tubular liner (not shown) with a profiled helical outer surface can be inserted therein. Tubular liner can be any material, for example, metal or elastomer.

Figure 28:
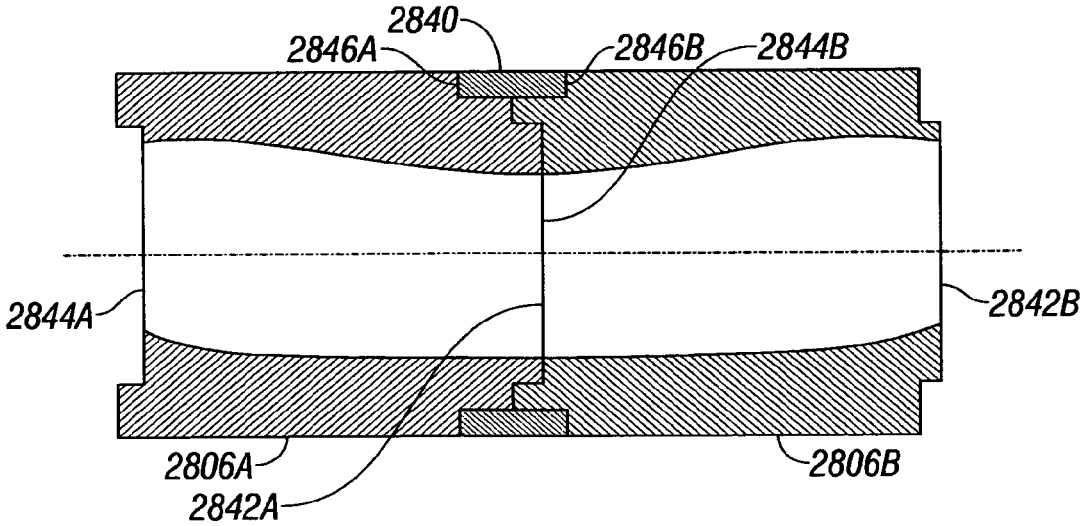
FIG. 28 is a cross-sectional view of a nested joint between adjacent tube sections with profiled helical bores, the nested joint aligned by a plurality of keys disposed in key slots, prior to threading of a tubular liner to form a stator, according to one embodiment of the invention.

FIG. 28 illustrates another means for aligning the profiled helical bores of a plurality of tube sections (2806A, 2806B). A first tube section 2806A has a female end 2844A and an opposing male end 2842A. Second tube section 2806B has a male end 2842B and a female end 2844B shown receiving male end 2842A of first tube section 2806A. By using a nested joint (2842A, 2844B), the tube sections can be coaxially aligned. However, to facilitate rotational or radial alignment of the profiled helical bores of the tube sections (2806A, 2806B), a key 2840 can be used. Note that the term "key" here is not limited to being the same key as any key used in the embodiments described in reference to FIG. 14 or 25. The use of a key for a mechanical interlock is known to one of ordinary skill in the art. A first key slot 2846A can be formed adjacent an end of the first tube section 2806A and a second key slot 2846B can be formed adjacent an end of the second tube section 2806B. A set of key slots (2846A, 2846B) can be formed so as to align the profiled helical bores of the tube sections (2806A, 2806B) when a key is inserted into the larger slot formed by said slots when abutting and aligned. The key slots (2846A, 2846B) can be formed in an exterior surface of the tube sections (2806A, 2806B) as shown. A plurality of keys 2840 and respective key slots (2846A, 2846B) can be used to align any number of tube sections without departing form the spirit of the invention. Nesting joints can be used alone or in conjunction with dowels and dowel pin cavities as discussed in reference to FIG. 27.

Figure 29:
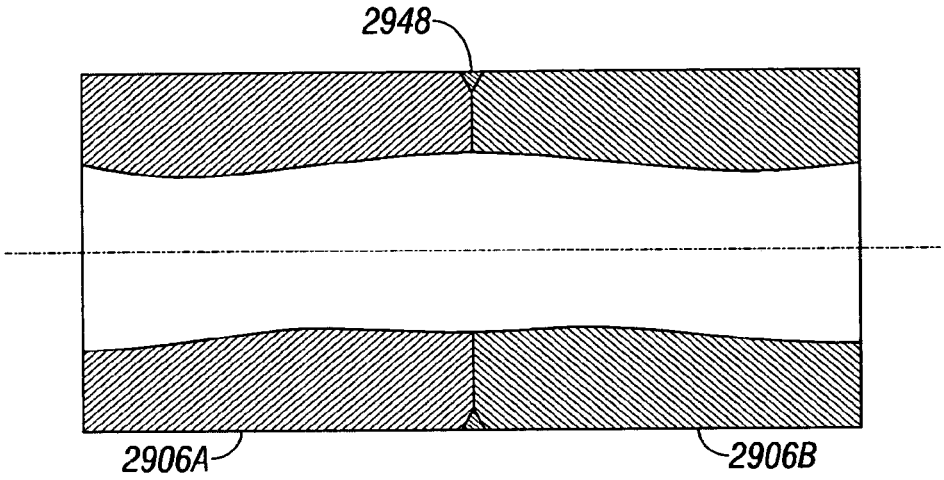
FIG. 29 is a cross-sectional view of tube sections with profiled helical bores joined by a weld therebetween, prior to threading of a tubular liner to form a stator, according to one embodiment of the invention.

FIG. 29 illustrates two tube sections (2906A, 2906B) joined by a weld 2948 formed therebetween. Any means of radial and/or axial alignment, including, but limited to, those disclosed above, can be utilized to align the profiled helical bores before welding or otherwise joining the tube sections. Weld 2948 can be a circumferential weld and in one embodiment is a low temperature weld, for example, electron beam, so at to minimize any warping of the profiled helical bores. Such alignment and/or joining methods enable limited lengths of tubes to be skinned. Skinning enables previously unusable lengths of tubes with a profiled helical bore to have a continuous profiled helical surface (i.e., the active inner surface of a stator) that is typically preferred in a progressive cavity apparatus. Further, welding is not required to join the tube sections together, for example, compression can be applied to the ends of aligned tube sections to join them. In such an embodiment, the use of nested joints, keys and/or dowel pins is preferred.

Figure 30:
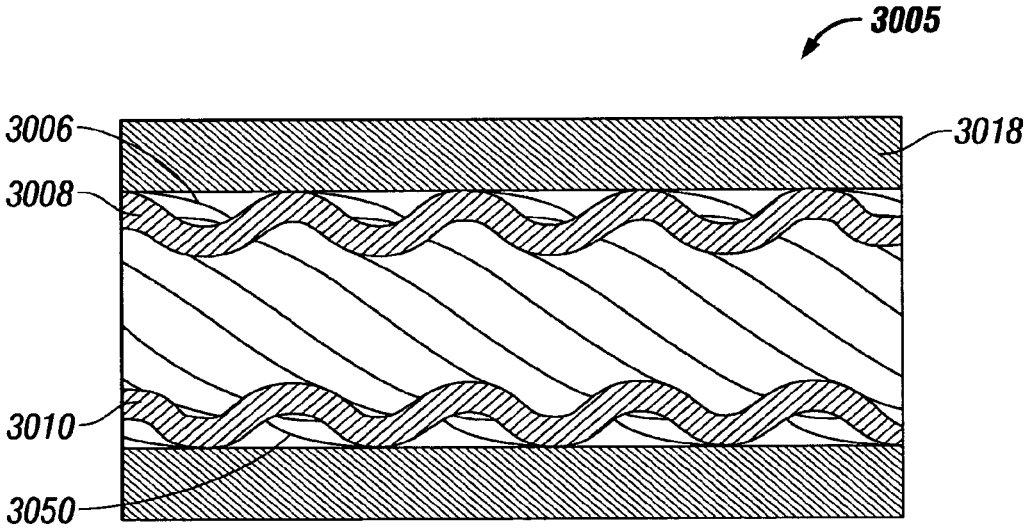
FIG. 30 is a cross-sectional view of a stator formed from a tubular liner disposed within the profiled helical bore of a tube, the tube having a profiled helical inner and profiled helical outer surface and the tube being disposed within a tubular housing, according to one embodiment of the invention.

FIG. 30 is a tube 3006 with a profiled helical bore 3008 and a profiled helical outer surface. Tube 3006 is disposed in a tubular housing 3018 having a cylindrical bore. Tubular housing 3018 can be included when the tube 3006 is structurally insufficient for use in a progressive cavity apparatus, for example, when the tube 3006 cannot withstand the operating pressure differential and/or bending forces experienced in a curved hole. Tubular housing 3018 can be used as a mounting surface for stabilizer sleeves, if so desired. Tubular liner 3010 can be threaded into the profiled helical bore 3008 of the tube 3006 as disclosed herein to skin the tube 3006 to form stator 3005. The void space 3050 between outer profiled helical surface of tube 3006 and cylindrical bore of tubular housing 3018 can remain unfilled or be filled with potting material, such as a resin, as discussed in US11/496562 titled "Controlled Thickness Resilient Material Lined Stator and Method of Forming", herein incorporated by reference. Further, the helical void space 3050 can be vented to well bore pressure and/or vented to the inlet or discharge of a power section, for example, for pressure equalization.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A rotor of a progressive cavity apparatus comprising:

a core with a profiled helical outer surface;

a sleeve with a profiled helical inner and a profiled helical outer surface prior to combination with the core, the sleeve removably received on the core, the sleeve comprising a resilient layer of material; and a retention mechanism between the core and the sleeve to prevent rotation of the resilient layer with respect to the core.

2. The rotor of claim 1 wherein the resilient layer is coupled directly to the core by the retention mechanism in the form of an adhesive.

3. The rotor of claim 1 wherein the sleeve comprises a non-compliant material.

4. The rotor of claim 3 wherein the sleeve further comprises an outer coating of chrome.

5. The rotor of claim 1 wherein the sleeve comprises a semi-compliant material.

6. The rotor of claim 1 wherein the sleeve comprises a slightly compliant material.

7. The rotor of claim 1 wherein the sleeve comprises the resilient layer, in the form of a resilient outer layer, and a semi-compliant inner layer.

8. The rotor of claim 1 wherein the sleeve comprises a slightly compliant outer layer and the resilient layer, in the form of a resilient inner layer.

9. The rotor of claim 1 wherein the sleeve comprises the resilient layer, in the form of a resilient outer layer, and a non-compliant inner layer.

10. The rotor of claim 1 wherein the sleeve comprises a resilient outer layer and a mesh tube inner layer.

11. The rotor of claim 1 wherein the sleeve comprises a mesh tube encapsulated by a layer of a resilient material.

12. A method of skinning a rotor of a progressive cavity apparatus comprising:

providing a core;

inserting the core into a sleeve formed with a layer of resilient material and having a profiled helical outer surface and a longitudinal bore, the longitudinal bore removably receiving the core; and using a retention feature along the longitudinal bore to prevent rotation of the sleeve with respect to the core.

13. The method of claim 12 wherein a transverse cross-section of the core and a transverse cross-section of the longitudinal bore are circular.

14. The method of claim 12 wherein a transverse cross-section of the core and a transverse cross-section of the longitudinal bore are polygonal to restrict relative rotation therebetween.

15. The method of claim 12 further comprising engaging a key in a key slot in an end of the core and an adjacent end of the sleeve to restrict relative rotation therebetween.

16. The method of claim 12 wherein the step of inserting the core into the sleeve comprises threadably engaging a threaded outer surface of the core into a threaded inner surface of the longitudinal bore.

* * * * *